US008899220B2

(12) United States Patent
Morris, II

(10) Patent No.: US 8,899,220 B2
(45) Date of Patent: Dec. 2, 2014

(54) ARCHERY APPARATUS, SYSTEM, AND METHOD WITH AUTOMATIC DEVICE ACTIVATION

(71) Applicant: Edward J. Morris, II, Bivalve, MD (US)

(72) Inventor: Edward J. Morris, II, Bivalve, MD (US)

( * ) Notice: Subject to any disclaimer, the term of this patent is extended or adjusted under 35 U.S.C. 154(b) by 14 days.

(21) Appl. No.: 13/713,011

(22) Filed: Dec. 13, 2012

(65) Prior Publication Data

US 2013/0098344 A1 Apr. 25, 2013

Related U.S. Application Data

(63) Continuation-in-part of application No. 12/874,941, filed on Sep. 2, 2010, now Pat. No. 8,528,535, which is a continuation-in-part of application No. 12/780,394, filed on May 14, 2010, now Pat. No. 8,387,608.

(51) Int. Cl.

| | |
|---|---|
| ***F41B 5/10*** | (2006.01) |
| ***F41G 1/34*** | (2006.01) |
| ***F41B 5/14*** | (2006.01) |
| ***F41G 1/35*** | (2006.01) |
| ***F41G 1/467*** | (2006.01) |

(52) U.S. Cl.

CPC ..... *F41B 5/1484* (2013.01); *F41G 1/345* (2013.01); *F41B 5/1488* (2013.01); *F41B 5/1403* (2013.01); *F41B 5/148* (2013.01); *F41B 5/10* (2013.01); *F41B 5/1492* (2013.01); *F41G 1/35* (2013.01); *F41B 5/1469* (2013.01); *F41G 1/467* (2013.01)

USPC ..... 124/86; 124/23.1; 124/25.6

(58) Field of Classification Search

CPC ..... F41B 5/10; F41B 5/1434

USPC ..... 124/23.1, 25.6, 86, 87, 88

See application file for complete search history.

(56) References Cited

U.S. PATENT DOCUMENTS

| | | | | |
|---|---|---|---|---|
| 3,739,167 | A | 6/1973 | Avery | |
| 4,134,383 | A | 1/1979 | Flood | |
| 4,741,320 | A | 5/1988 | Wiard | |
| 5,060,626 | A * | 10/1991 | Elliott et al. | 124/86 |
| 5,205,268 | A | 4/1993 | Savage | |
| 5,297,533 | A | 3/1994 | Cook | |
| 5,435,292 | A * | 7/1995 | Armstrong | 124/86 |
| 7,337,773 | B2 | 3/2008 | Simo et al. | |
| 2008/0000465 | A1 | 1/2008 | Holmberg | |
| 2010/0043765 | A1 | 2/2010 | Lang | |

OTHER PUBLICATIONS

U.S. Appl. No. 12/780,394—Non-Final Office Action dated Jun. 5, 2012.

U.S. Appl. No. 12/780,394—Notice of Allowance dated Nov. 5, 2012.

U.S. Appl. No. 12/874,941—Office Action dated Nov. 26, 2012.

U.S. Patent Application No. 12/780,394 — Allowed Claims.

U.S. Patent Application No. 12/874,941 — Notice of Allowance dated May 13, 2013.

U.S. Patent Application No. 12/874,941 — Allowed Claims.

* cited by examiner

*Primary Examiner* — John Ricci

(74) *Attorney, Agent, or Firm* — Miles & Stockbridge P.C.

(57) ABSTRACT

Systems, apparatuses, and methods for automatically activating and/or controlling one or more accessory devices for an archery apparatus, including circuitry for automatically activating and/or controlling one or more electrical or electronic accessory devices in response to, for example, the bow string of the archery apparatus being drawn. The electrical or electronic accessory devices can include a sight light, a stabilizing light, a spot light, a video recorder, a photographic camera, an audio enhancement pickup, a fishing reel, a range finder, sights, a lighted quiver, and a game call.

22 Claims, 14 Drawing Sheets

ARCHERY APPARATUS, SYSTEM, AND METHOD WITH AUTOMATIC DEVICE ACTIVATION

FIELD OF THE INVENTION

The present invention relates to systems, apparatuses, and methods for automatically activating and/or controlling one or more accessory devices for an archery apparatus. In particular, the present invention relates to circuitry for automatically activating and/or controlling one or more electrical accessory devices for a compound archery bow.

SUMMARY

Various disclosed embodiments (i.e., one, some, or all) of the present invention relate to a compound archery bow comprising: a bow string; and an elongate body operatively coupled to the bow string. The body can include an integrated selector, a grip portion having an integrated momentary switch, an integrated stabilizer mounting port, and a plurality of accessory attachment ports. Optionally, the momentary switch can include a wireless transmitter and the selector can include a wireless transceiver, wherein the momentary switch and the selector can be configured to communicate wirelessly with each other via the transmitter and transceiver. Optionally, the selector can be configured to selectively control wireless communication from the momentary switch for one or more electronic accessory devices mechanically coupled to respective accessory attachment ports, and the momentary switch can be configured to be activated so as to activate one or more of the electronic accessory devices mechanically coupled to respective accessory attachment ports based on the selective control of the selector. One or more electronic accessory devices can each include a receiver to receive wireless communication from the compound archery bow. Optionally, the one or more electronic accessory devices can receive wireless communication from the selector based on communication from the transmitter of the momentary switch. The selector can include visual indicators to indicate selective control of the one or more electronic accessory devices. The momentary switch can be configured to be activated by a user of the bow. The electronic accessory devices can include at least one of a light, a stabilizing light, a spot light, a video device, a photographic device, an audio enhancement device, a reel device, a game calling device, a range finder device, a sighting device, and a lighted quiver device. Optionally, when one of the electronic accessory devices includes a stabilizing light, the stabilizer mounting port can be mechanically coupled to the stabilizing light, and the stabilizing light can be wirelessly controlled by the selector and the momentary switch. Optionally, upon activation, power to the one or more electronic accessory devices mechanically coupled to respective accessory attachment ports based on the selective control of the selector can be provided from respective power sources of the one or more electronic accessory devices. Optionally, the one or more electronic accessory devices can receive wireless communication from the transmitter of the momentary switch based a selection configuration of the selector. The selector can be configured to allow none, only one, only some, or all electronic accessory devices to be operated at one time, with each said electronic accessory device having its own control frequency associated therewith.

Various embodiments also include an archery apparatus comprising: a bow string; and a body operatively coupled to the bow string, wherein the body can include a grip portion, a wireless control device, and one or more accessory ports.

Each of the accessory ports can provide a mechanical coupling to the body for respective electrical accessory devices. The wireless control device can be configured to wirelessly control electrical accessory devices coupled to the body, wherein the wireless controlling includes controlling a supply of power. The wireless control device also can be configured to be activated by a user of the archery apparatus, wherein the activation of the wireless control device can provide power to certain electrical accessory devices coupled to the body. Optionally, the supply of power can include power supplies for each of the electrical accessory devices, wherein the power supplies can be respectively provided by the electrical accessory devices, and the wireless control can be provided by one of RF signals or IR signals. The electrical accessory devices can include at least one of a light, a stabilizing light, a spot light, a video device, a photographic device, an audio enhancement device, a reel device, a game calling device, a range finder device, a sighting device, and a lighted quiver device.

Various embodiments also can include a system for controlling activation of one or more accessory devices electrically coupled to an archery apparatus. The system can comprise means for wirelessly controlling power supplied to the one or more accessory devices for activation thereof; and means for coupling to a first external body portion of the archery apparatus the means for wirelessly controlling power. Optionally, the system can further comprise means for wirelessly selecting the one or more accessory devices for activation thereof; and means for coupling to a second external body portion of the archery apparatus the means for wirelessly selecting the one or more accessory devices for activation. The means for wirelessly controlling power can include wireless connection means for wirelessly communicating with the means for wirelessly selecting the one or more accessory devices for activation, wherein the wireless connection means can be exposed from the body of the archery apparatus. Optionally, the means for wirelessly selecting the one or more accessory devices for activation can use a plurality of wireless communication channels, each of the one or more accessory device having associated therewith one of the plurality of wireless communication channels. Optionally, the means for wirelessly controlling power can include means for selecting said one or more accessory devices for activation thereof. The means for wirelessly selecting the one or more accessory devices for activation can be configured to selectively allow none, only one, only some, or all electrical accessory devices to be operated substantially simultaneously.

Various embodiments can also include a method comprising: coupling a plurality of devices each having an electrical component to respective receptacles of a compound bow; operating one or both of a momentary switch and a selector to selectively and wirelessly control the electrical components of the devices; and prior to operating one or both of a momentary switch and a selector to wirelessly control the electrical component of the device, performing a device discovery operation to identify the devices coupled to the receptacles of the compound bow, the device discovery operation being performed by an electronic controller. Optionally, the device discovery operation can be performed automatically, continuously, and/or periodically by the electronic controller.

BRIEF DESCRIPTION OF THE DRAWINGS

The accompanying drawings illustrate embodiments of the disclosed subject matter. The disclosed subject matter will be best understood by reading the ensuing specification in conjunction with the drawing figures, in which like elements are designated by like reference numerals, and wherein.

DETAILED DESCRIPTION

Figure 1:
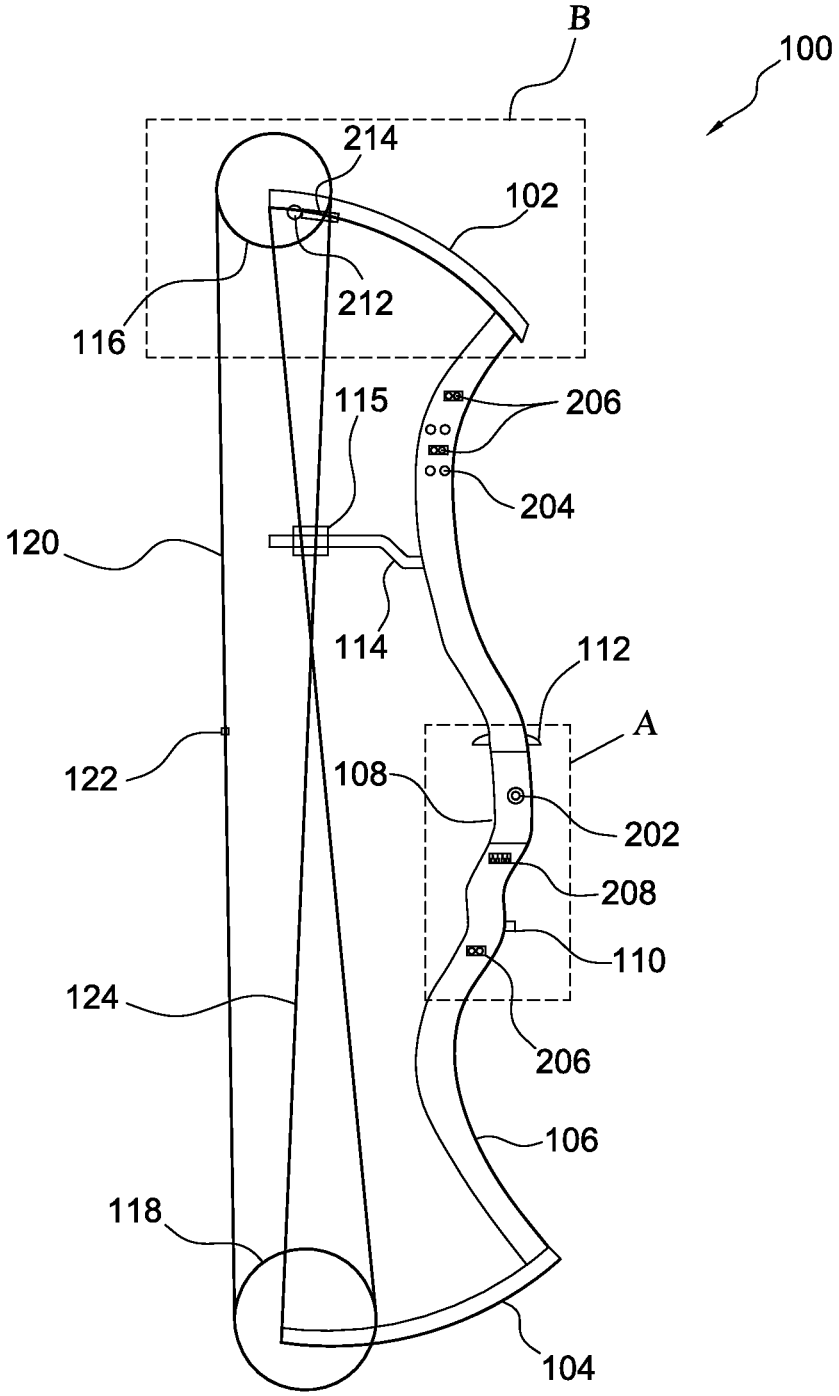
FIG. 1 is a side view drawing of a compound archery bow according to various embodiments of the disclosed subject matter.

Generally speaking, various embodiments of the present invention involve an archery apparatus, such as an archery bow used for hunting game, for example, wherein the archery apparatus can provide for automatic activation and/or operation (wirelessly or otherwise) of one or more electrical or electronic accessory devices in relative proximity to the apparatus and/or coupled to the apparatus, either substantially permanently or removably. Automatic activation or operation of selected electrical or electronic accessory devices can be triggered when tension is applied to the bowstring, such as when the user draws back on the bowstring, and can include simultaneous activation of one or more devices. Automatic activation and/or operation can also include, after activating the devices, immediately deactivating one or more of the devices, deactivating one or more of the devices after a predetermined period of time, and/or allowing one or more of the devices to remain activated until they are manually deactivated by the user. The archery apparatus can also provide for user control and/or activation (wirelessly or otherwise) of one or more electrical or electronic accessory devices coupled to the apparatus, either substantially permanently or removably. The archery apparatus can be "configured" and/or "reconfigured" by coupling thereto any suitable electrical or electronic accessory device. Various embodiments can comprise, for example, an electronic control device for use by a user of the archery apparatus to activate (wirelessly or otherwise) any electrical or electronic device mounted on (or in relative proximity to) the archery apparatus with, for example, a touch of a button, while at full draw, for instance, or by touching or applying tension to the bowstring, such as drawing back on the bowstring. Generally speaking, for an electronic control device of wireless type, which can be either substantially permanently or temporarily affixed to the bow 100, the electronic control device can wirelessly communicate with respective wireless receivers associated with one or more electrical or electronic accessory devices to control and/or activate the accessory devices. For example, a draw sensor can be coupled to an electronic control device to wirelessly communicate with respective wireless receivers associated with one or more electrical or electronic accessory devices to control and/or activate the accessory devices when a user touches and/or applies tension to the bowstring, such as when a user draws back on the bowstring. In another example, multiple electronic control devices can be used; one can be used to control and/or activate selected accessory devices when a user draws back on the bowstring while another is used to control and/or activate selected accessory devices when a user presses a button. Optionally, some or all of the wireless receivers can be built in to each of the accessory devices. Alternatively, some or all of the wireless receivers can be part of the bow itself. The wireless communication can be of any suitable format, such as by infrared ("IR") signals or by radio frequency ("RF") signals. In such embodiments, the wireless communication interface can be provided in conformance with one or more open or closed wireless technology standards or protocols for exchanging data over short distances, such as, for example, but not limited to, Bluetooth® and/or IEEE 802.15.1 or a wireless local area network ("WLAN") in conformance with IEEE 802.11. Furthermore, in various embodiments, each electronic or electrical accessory device can be operated wirelessly via its own control frequency. For example, each electronic or electrical accessory device can be operated wirelessly using its own unique communication channel or code, for example, based on a setting or selection of a selector. Optionally, the electronic control device of wireless type can perform a device discovery operation to identify electrical or electronic accessory devices coupled to receptacles or in proximity to the compound bow. In various embodiments the device discovery operation is performed automatically. Optionally, the device discovery operation is performed automatically, continuously, and/or periodically. Optionally, the device discovery procedure can associate certain electrical or electronic accessory devices coupled to receptacles or in relative proximity to the compound bow with one or more electronic control devices and/or wireless transmitters.

Figure 2A:
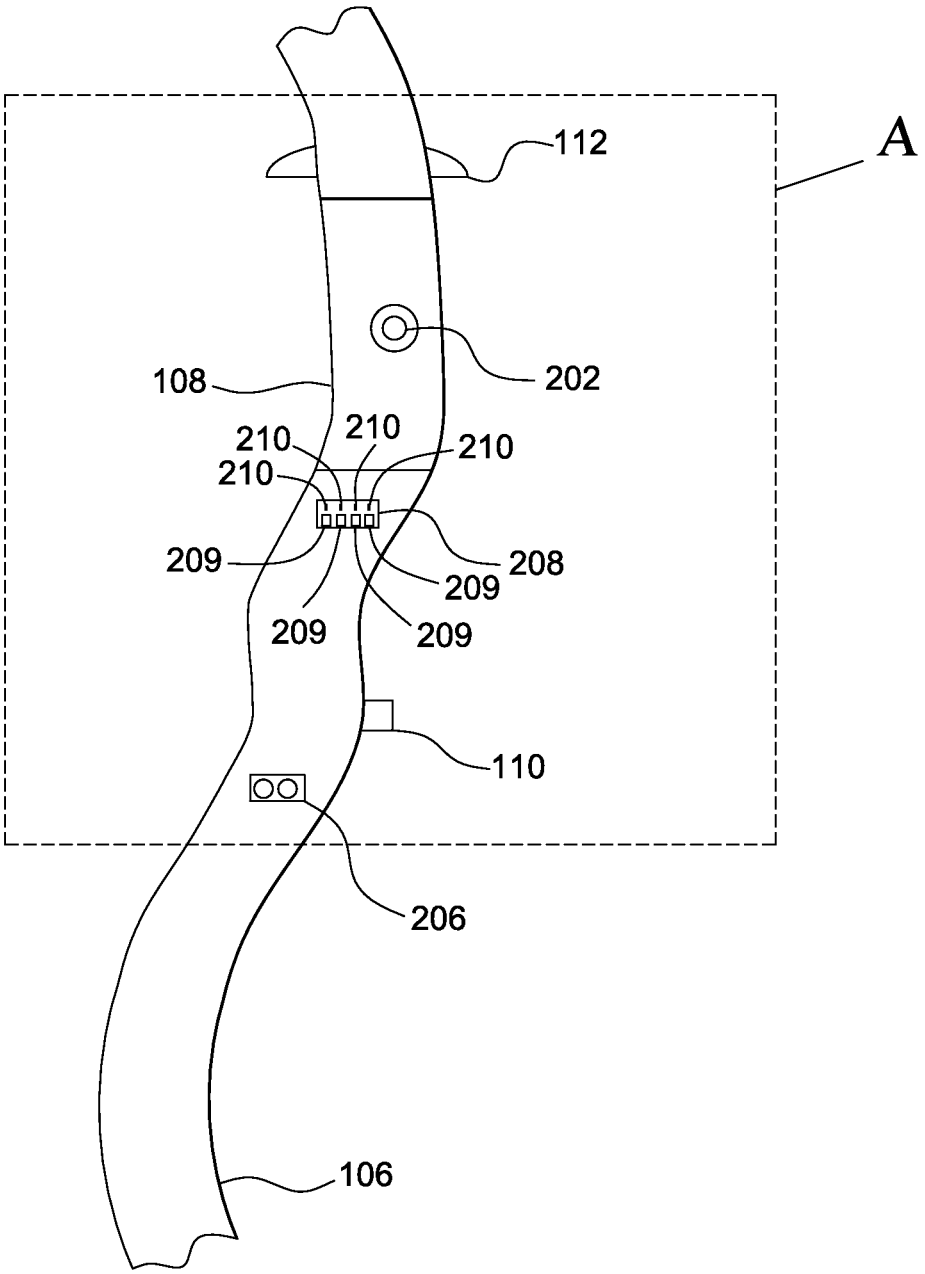
FIG. 2A is a close-up view of a portion 'A' from FIG. 1.
Figure 2B:
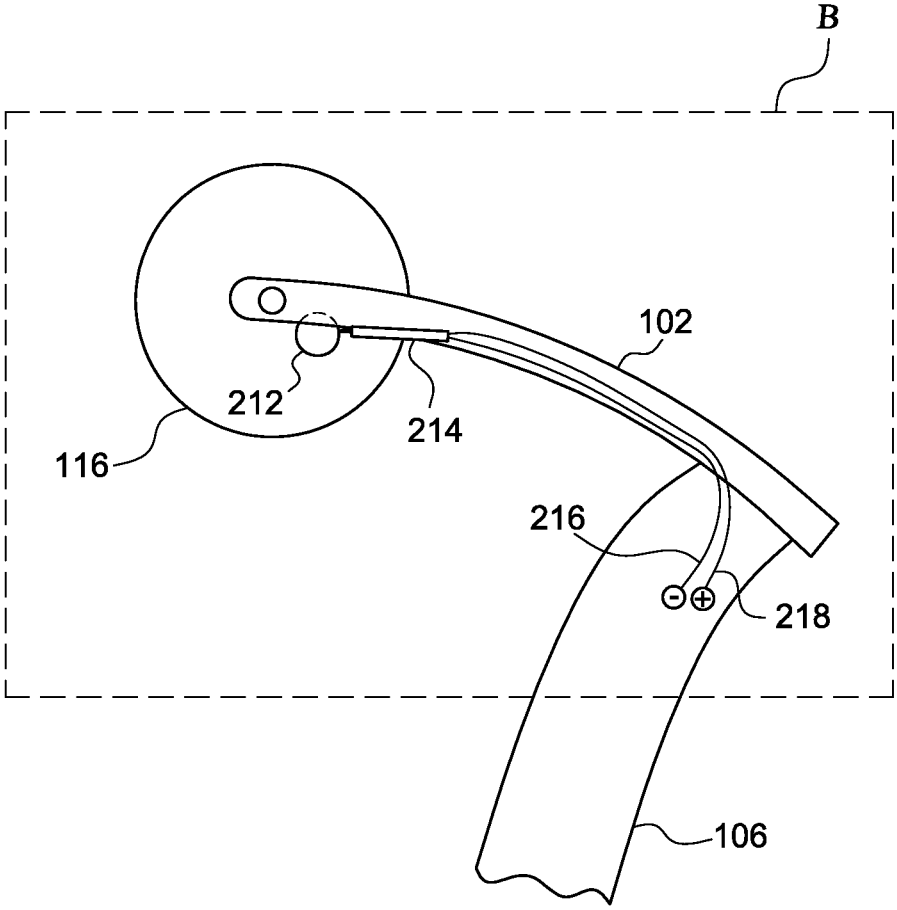
FIG. 2B is a close-up view of a portion 'B' from FIG. 1.

For example, FIG. 1 is a side view of a compound bow 100 according to various embodiments of the disclosed subject matter. FIG. 2A is a close up view of a portion 'A' from FIG. 1 and FIG. 2B is a close up view of a portion 'B' from FIG. 1. As noted above, generally, the compound bow 100 of FIGS. 1, 2A, and 2B can provide for automatic and/or manual user control and/or activation (wirelessly or otherwise) of one or more electrical or electronic accessory devices in relative proximity to the bow 100 and/or coupled to the bow 100, either substantially permanently or removably.

Compound bow 100 can comprise a body having an upper limb 102, a lower limb 104, a riser 106, a grip 108, a stabilizer mounting port 110, and an arrow rest 112. The physical arrangement and shapes of the aforementioned features can be such as shown in FIGS. 1 and 2, for example, wherein a portion of the bow containing the grip 108, stabilizer mounting port 110, and arrow rest 112 is coupled between upper limb 102 and lower limb 104. The body of the compound bow 100 also may have a cable guard 114 having a cable slide 115 coupled thereto, as well as an idler wheel 116 coupled to upper limb 102, a cam 118 coupled to lower limb 104, a cable 124 coupled to idler wheel 116 and cam 118, and a bow string 120 having a knock location 122 and being coupled to idler wheel 116 and cam 118.

Optionally, stabilizer mounting port 110 can be an electrically conductive mounting port connected to circuitry integrated into the body of the compound bow 100 and for connection to electrical or electronic accessory devices, such as a stabilizing light. Such an electrically conductive mounting support can provide both mechanical and electrical coupling for one or more electrical or electronic accessory devices configured to be coupled mechanically and electrically thereto. Alternatively, stabilizer mounting port 110 can provide physical mounting for an electrical or electronic accessory device, such as a stabilizing light, wherein the accessory device can be wirelessly controlled by an electronic control device.

Optionally, various embodiments of compound bow 100 also can have a momentary switch 202, one or more accessory mounts or ports 204, and one or more electrical ports 206. Optionally or alternatively, compound bow 100 can have a selector 208. Optionally, compound bow 100 can have one or more power supplies (not explicitly shown) integrated in the body of the compound bow 100.

Figure 8A:
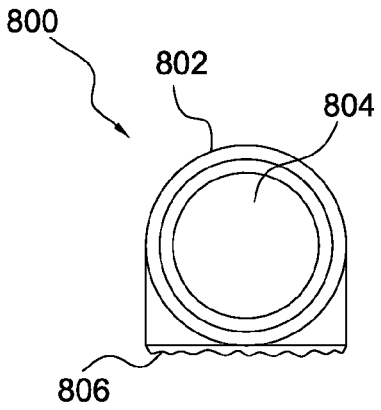
FIG. 8A is a front view of a draw sensor in the form of a cam switch according to various embodiments of the disclosed subject matter.
Figure 8B:
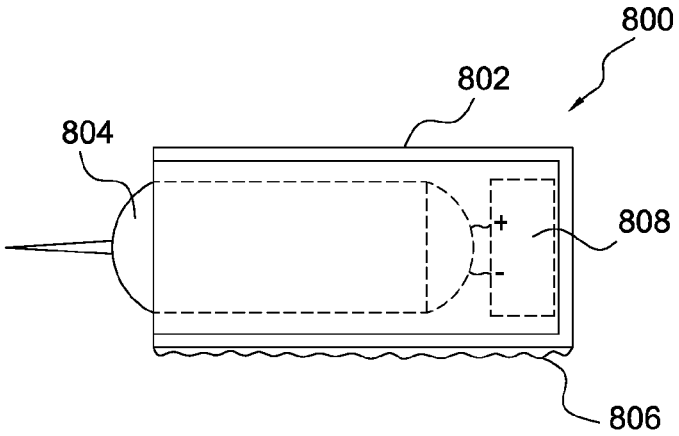
FIG. 8B is a side view of a draw sensor in the form of a cam switch with wireless transmitter according to various embodiments of the disclosed subject matter.
Figure 8C:
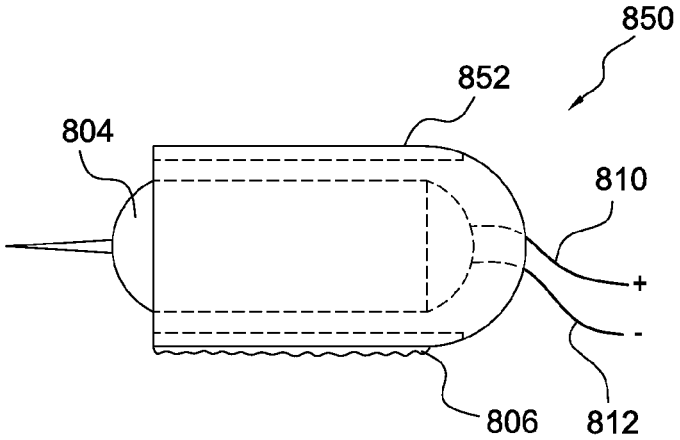
FIG. 8C is a side view drawing of a draw sensor in the form of a cam switch according to various embodiments of the disclosed subject matter.

Optionally, various embodiments of compound bow 100 also can have a draw sensor comprising a cam switch 214 and a magnet 212 coupled to cam 118 or idler wheel 116. As shown in FIG. 2B, the cam switch 214 can be coupled to upper limb 102 and magnet 212 can be coupled to idler wheel 116. In embodiments where the magnet 212 is coupled to cam 118, the cam switch 214 can be coupled to lower limb 104. In various embodiments, the cam switch 214 can include a reed switch as shown in FIGS. 8A, 8B, and 8C. In such embodiments, the reed switch is normally open when the bow string 120 is in a resting position and when a user applies tension to the bowstring, such as when a user draws back on the bow string 120, the magnet 212 coupled to the cam 118 or idler wheel 116 rotates causing a magnetic field to rotate away from the normally open reed switch which then closes to activate and/or control (wirelessly or otherwise) one or more electrical or electronic accessory devices coupled to or otherwise in relative proximity to the bow 100. In such embodiments, the reed switch circuit will remain closed until the tension applied to the bow string 120 is released or reduced, such as when the user releases the bow string 120 and the magnetized cam or idler wheel 702 and bow string 120 return to their resting position which causes the reed switch circuit to open. In some embodiments, cam 118 or idler wheel 116 can be magnetized. In such embodiments the magnet 212 would not be necessary as the magnetized cam or magnetized idler wheel could provide the magnetic field without the need for an additional magnet 212.

In some embodiments not shown, the draw sensor can include one or more mechanical, mercury, optical, tension, and/or other switches and/or sensors. In such embodiments, the switches/sensors can be placed in various locations on the bow 100, such as but not limited to, the bow limbs (upper limb 102 and lower limb 104), riser 106, grip 108, stabilizer mounting port 110, arrow rest 112, cable guard 114, cable slide 115, idler wheel 116, cam 118, cable 124, bow string 120, knock location, string suppressors, cable rod, or any area of the bow 100 where movement and/or tension can occur and activate switches and/or sensors when, for example, a user draws back on the bow string 120.

In various embodiments, the electronic control device can include momentary switch 202 and/or selector 208 and/or a draw sensor such as cam switch 214. Furthermore, optionally, the electronic control device can be a wireless control device that can wirelessly control and/or activate one or more electrical or electronic accessory devices coupled to or otherwise in relative proximity to the electronic control device. In various embodiments, the electronic control device can include a wireless transmitter for communicating (i.e., transmitting) wireless signals to receivers associated with the aforementioned electrical or electronic accessory devices coupled to or otherwise in relative proximity to the electronic control device. In various embodiments, the electronic control device (of the wireless type or otherwise) can control power supplied to the aforementioned electrical or electronic accessory devices. Optionally, power supplied to the electrical or electronic accessory devices can be provided by power supplies located on the electrical or electronic accessory devices themselves. In the case of an electronic control device of the wireless type comprised of momentary switch 202 and selector 208, the momentary switch can include a wireless transmitter (e.g., an RF or IR transmitter) and the selector can include a wireless transceiver (e.g., an RF or IR transceiver). In such embodiments, the momentary switch and the selector can communicate wirelessly with each other via the wireless transmitter and transceiver to control and/or activate one or more electrical or electronic accessory devices based on a user input; the momentary switch and/or the selector can communicate wirelessly with wireless receivers (e.g., an RF or IR receiver) of the one or more electrical or electronic accessory devices. For example, in various embodiments, the selector can be set or otherwise used to selectively control wireless communication from the momentary switch for one or more electronic or electrical accessory devices. Thus, in this example, one or more of the electronic or electrical accessory devices can be selectively activated (e.g., power turned on) based on the configuration of the selector. Optionally, wireless communication can be provided by the momentary switch directly to the one or more electronic devices based on the configuration of the selector. Optionally or alternatively, the one or more electronic accessory devices can receive wireless communication from the selector based on wireless communication from the transmitter of the momentary switch.

In some embodiments, an electronic control device of the wireless type can be comprised of selector 208 and a draw sensor such as cam switch 214, the draw sensor can include a wireless transmitter (e.g., an RF or IR transmitter) and the selector can include a wireless transceiver (e.g., an RF or IR transceiver). In such embodiments, the draw sensor and the selector can communicate wirelessly with each other via the wireless transmitter and transceiver to control and/or activate one or more electrical or electronic accessory devices when tension is applied to the bowstring, such as when a user draws back on the bow string 120; the draw sensor and/or the selector can communicate wirelessly with wireless receivers (e.g., an RF or IR receiver) of the one or more electrical or electronic accessory devices. For example, in various embodiments, the selector can be set or otherwise used to selectively control wireless communication from the draw sensor for one or more electronic or electrical accessory devices. Thus, in this example, one or more of the electronic or electrical accessory devices can be selectively activated (e.g., power turned on) based on the configuration of the selector. Optionally, wireless communication can be provided by the draw sensor directly to the one or more electronic devices based on the configuration of the selector. Optionally or alternatively, the one or more electronic accessory devices can receive wireless communication from the selector based on wireless communication from the transmitter of the draw sensor.

In various embodiments, cam switch 214 can be used as a draw sensor to control or activate one or more accessory devices coupled to the compound bow 100 (devices not shown in FIGS. 1, 2A, 2B, and 7). As will be discussed in more detail later, each accessory device can be either substantially permanently fixed or removably coupled to the body of the compound bow 100. Furthermore, optionally, cam switch 214 can include a wireless communication capability, and the cam switch 214 includes a wireless transmitter for wirelessly controlling and/or activating one or more electrical or electronic accessory device.

Momentary switch 202 can be of any suitable configuration, including configurations capable of being depressed or otherwise "switched" by a user of the compound bow 100 (e.g., a continuity switch). Momentary switch 202 can be integrated or formed essentially in one piece with the body of the compound bow 100, for example, during the manufacturing process. Alternatively, momentary switch 202 can be affixed, substantially permanently or removably, to the body of the compound bow 100 after the manufacturing process. Furthermore, momentary switch 202 can be provided at any suitable location on the body of the compound bow 100. Generally speaking, momentary switch 202 can be arranged on the body of the compound bow 100 at a position where a user may access the momentary switch 202 at particular instances, such as when the user is "shooting" or "aiming" the compound bow 100, using the compound bow 100 for guidance or tracking purposes (e.g., activating a flashlight coupled to the bow and switch), etc. Incidentally, momentary switch 202 can be arranged on either side of the body of the compound bow 100, depending on the "handedness" (i.e., left or right "handed") of the compound bow 100. FIGS. 1 and 2, for example, show momentary switch 202 being arranged on one side of grip 108. Alternatively, momentary switch 202 can be arranged either above or below grip 108.

In various embodiments, momentary switch 202 and/or cam switch 214 can be used to control or activate one or more accessory devices coupled to the compound bow 100 (devices not shown in FIGS. 1, 2 and 2B). As will be discussed in more detail later, each accessory device can be either substantially permanently fixed or removably coupled to the body of the compound bow 100. Furthermore, optionally, momentary switch 202 and/or cam switch 214 can include a wireless communication capability, and the momentary switch 202 and/or cam switch 214 can include a wireless transmitter for wirelessly controlling and/or activating one or more electrical or electronic accessory device.

Momentary switch 202 and/or cam switch 214 can be operative in any suitable way for making and breaking electrical contact. For example, momentary switch 202 can operate such that when activated, by a user of the compound bow 100, for example, the momentary switch 202 makes contact for a set time period and then automatically releases, after a delay (which can be set and/or adjusted by the manufacturer or the user), to open the circuit, regardless of whether the switch is "held down" or released. Such feature can be advantageous in that the user may not have to concentrate on holding down the button, for example, while aiming or shooting. Alternatively, momentary switch 202 can remain closed as long as the user holds or pushes down a button or otherwise activates a mechanism associated with activation of the momentary switch 202. Cam switch 214 can operate such that, for example, when activated by a user of the compound bow 100 applying tension to the bow string 120, such as by drawing back the bow string 120, the cam switch 214 makes electrical contact for a predetermined time period and then automatically releases, after a delay (which can be set and/or adjusted by the manufacturer or the user), to open the circuit, regardless of whether the tension remains in the bow string 120, for example, regardless of whether the bow string 120 remains drawn or is released. Alternatively, cam switch 214 can remain closed as long as the tension remains in the bow string 120, such as while the bow string 120 is drawn.

In various embodiments, cam switch 214 can operate such that, for example, a predetermined activation threshold of tension applied to or movement of the bow string 120 must be exceeded before the cam switch 214 is activated, and optionally or alternatively, cam switch 214 can operate such that a predetermined deactivation threshold of tension released from or movement of the bow string 120 must be exceeded before the cam switch 214 is deactivated. In such embodiments, for example, a larger activation threshold of tension or movement of the bow string 120 may be predetermined to activate the cam switch 120 when the bow string 120 is substantially drawn back, and a lower deactivation threshold of tension released from or movement of the bow string 120 may be predetermined such that a small release of tension of movement of the bow string 120 from the substantially drawn state allows for deactivation of cam switch 214.

In various embodiments, momentary switch 202 and/or cam switch 214 can be electrically coupled to the stabilizer mounting port 110 (if the stabilizer mounting port 110 is of the conductive type), to one or more of the accessory mounts 204 (if of the conductive type), and/or to the one or more electrical ports 206. In various embodiments, the electrical connections or connectors (e.g., circuitry, such as wires, contacts, switches, etc.) between the momentary switch 202 and/or cam switch 214 and the stabilizer mounting port 110, the one or more accessory mounts 204, and the one or more electrical ports 206 can be integrated into or within the body of the compound bow 100. That is to the say, in various embodiments, substantially none of the electrical connections or connectors can be seen in plain view. Accordingly, various embodiments of the present invention provide internal connectivity.

Momentary switch 202 and/or cam switch 214 can be used to control or activate one or more electrical or electronic accessory devices electrically coupled thereto. For example, activation and deactivation of the momentary switch 202 can control a signal, power, voltage, or current supplied to a light electrical accessory device, such as a stabilizing light electrically accessory device, electrically and mechanically coupled to stabilizer mounting port 110. Incidentally, a stabilizing light electrical accessory device can be mechanically and/or electrically coupled to the momentary switch 202 and/or cam switch 214 by a threaded female receptacle or boss in the body of the compound bow 100, for example, the same as or similar to receptacles used for coupling of a stabilizer bar to the compound bow 100. In various embodiments that are comprised of momentary switch 202 and/or cam switch 214 without selector 208, activation of the momentary switch 202 and/or cam switch 214 may control and/or activate all or some of the electrical or electronic accessory devices electrically coupled to the body of the compound bow 100. Control and/or activation can include supplying a power source, such as power, voltage, or current to one or more accessory devices. Optionally, control and/or activation can include providing a signal, control or otherwise, to one or more of the accessory devices.

As mentioned above, optionally or alternatively, compound bow 100 can have a selector 208. Though the term "selector" has been used to describe element 208, its function is not limited to "selecting." For example, selector 208 may be manipulated to control one or more of the electrical or electronic accessory devices electrically coupled to it. As but one example, after activation of a video camera (using the momentary switch 202 and/or the cam switch 214 and/or the selector 208), selector 208 may be manipulated, by the user, to stop recording, pause recording, zoom in, zoom out, etc. Other electrical or electronic accessory devices can be controlled in a similar fashion, based on their respective characteristics.

Selector 208 can be integrated with the body of the compound bow 100, for example, during the manufacturing process. Optionally, selector 208 can be electrically coupled between momentary switch 202 and/or cam switch 214 and each electrical port 206 and each accessory mount 204 that is also an electrical conductor. Selector 208 can allow none, only one, only some, or all electrical or electronic accessory devices electrically coupled to the body of the compound bow 100 to be operated or controlled at one time or substantially simultaneously. Thus, momentary switch 202 and/or cam switch 214 can be electrically coupled directly to each electrical or electronic accessory device or can be routed through selector 208 for selectively controlling the electrical or electronic accessory devices electrically coupled to the body of the compound bow 100.

Selector 208 can be of any suitable configuration, such as one or more pushbuttons, levers, etc. Selector 208 in the dashed box 'A' in FIG. 2A, for example, shows four buttons 209. Selector 208 also may be configured with indicators 210, such as LEDs or other lights or indicia to indicate a state of the selector with respect to the electrical accessory devices, such as presently selected electrical accessory devices FIG. 2A, for example, shows four indicators 210 corresponding to the four buttons 209. Selector 208 can provide a signal, such as a control signal, and/or power to one or more of the selected electrical or electronic accessory devices.

In an alternative embodiment, selector 208 can replace completely momentary switch 202. Thus, electronic or electrical accessory devices coupled to the body of the compound bow 100 can be controlled and/or activated based on only selector 208. Selector 208 can provide a signal, such as a control signal, and/or power to one or more of the selected electrical or electronic accessory devices.

In another alternative embodiment, cam switch 214 can replace completely momentary switch 202. Thus, electronic or electrical accessory devices coupled to the body of the compound bow 100 can be controlled and/or activated based on only cam switch 214 and/or selector 208. Cam switch 214 can provide a signal, such as a control signal, and/or power to one or more of the selected electrical or electronic accessory devices.

The one or more accessory mounts 204 can be of any suitable configuration, such as a male, female, or combination male/female mount for mechanically and/or electrically coupling various electrical or electronic accessory devices to the body of the compound bow 100. Each individual accessory mount 204 can be integrated or formed essentially in one piece with the body of the compound bow 100, for example, during the manufacturing process.

The one or more electrical ports 206 can be of any suitable configuration, such as a male, female, or combination male/female receptacle for electrically coupling various electrical or electronic accessory devices to the body of the compound bow 100. Each electrical port 206 can be integrated or formed essentially in one piece with the body of the compound bow 100, for example, during the manufacturing process.

In various embodiments, one of said electrical ports 206 may be associated with a corresponding accessory mount 204. For example, a non-conductive accessory mount 204 may be for physically or mechanically coupling a particular electrical or electronic accessory device to the body of the compound bow 100 and an electrical connection for the electrical or electronic accessory device may be provided by the corresponding electrical port 206. In such embodiments, the electrical coupling means (e.g., a wire) from the accessory device to the electrical port 206 may be visible in plain view, with an end of the coupling means being plugged into, for example, the electrical port 206.

In various embodiments, the compound bow 100 can have one or more power supplies for supplying power to various electrical or electronic accessory devices. Each of the power supplies can be integral with the body of the compound bow 100 (e.g., arranged in a hollow portion of the body), or can be electrically and mechanically coupled to the body of the compound bow 100, for example, by using one or more mounts 204 and corresponding one or more of the electrical ports 206. Thus, various embodiments of the present invention can have power supplied to momentary switch 202 and/or selector 208 and/or cam switch 214, and consequentially to the mounts 204 of the electrically conductive type and electrical ports 206, and to the corresponding electrical or electronic accessory devices based on an external or internal power supply. Optionally, the power supply can come from one or more of the electrical or electronic accessory devices electrically coupled to the body of the compound bow 100. Optionally, the momentary switch 202 and/or selector 208 and/or cam switch 214 may provide a ground path for a power supply provided on the electrical or electronic accessory devices electrically coupled to the body of the compound bow 100. Optionally or alternatively, the compound bow 100 may have one or more solar panels to charge a battery integral with or affixed to the body of the compound bow 100, the battery in this case being the power supply or an alternative (e.g., backup) power supply for the various electrical or electronic accessory devices.

Applicants' invention is not limited to the specific compound bow 100 configuration shown in FIG. 1, and any suitable compound bow configuration may be used. Furthermore, though Applicants' disclosure and FIGS. 1, 2 and 2B have thus far described compound bows, the features described herein may be applicable to any suitable "bow" apparatus, including compound cross-bows and non-compound bows, such as a composite bow, a long bow, a crossbow, etc.

Electronic or electrical accessory devices for coupling to an archery apparatus according to various embodiments, such as compound bow 100, can include any suitable devices, such as for safety or for providing information to a user in real time. Such electronic or electrical devices can include a stabilizing light, a sight light, a spot light (where legal), a video recorder (e.g., a camcorder operated on a closed or open circuit), a photographic camera (including combined video/photographic devices), an audio enhancement pickup device, a fishing reel (e.g., for bow fishing), a game call, a range finder, a sight, an electric motor-driven device, a lighted quiver device, etc. Optionally, a range finder device implemented with the archery apparatus according to various embodiments can provide for one touch integrated range finding at full draw with LED display. Furthermore, sights that use lights, for example, can be implemented with the archery apparatus according to various embodiments such that the lights of the sight are activated only when needed, automatically by the cam switch 214 when tension is applied to the bow string 120 or when there is movement of the bow string 120, such as when the bow string 120 is drawn, and/or with a touch of the momentary switch 202 and/or selector 208. Such features can save battery life and eliminate extra movement in a tree stand, for example. Optionally, a range finder and a sight device may be a fully integrated system, whereby the range finder can compute distances to various objects and relay the information to an electronic sight that delivers accurate sight pin placement. In various embodiments, momentary switch 202 and/or selector 208 and/or cam switch 214 can assist with relaying information to the electronic sight.

Figure 3:
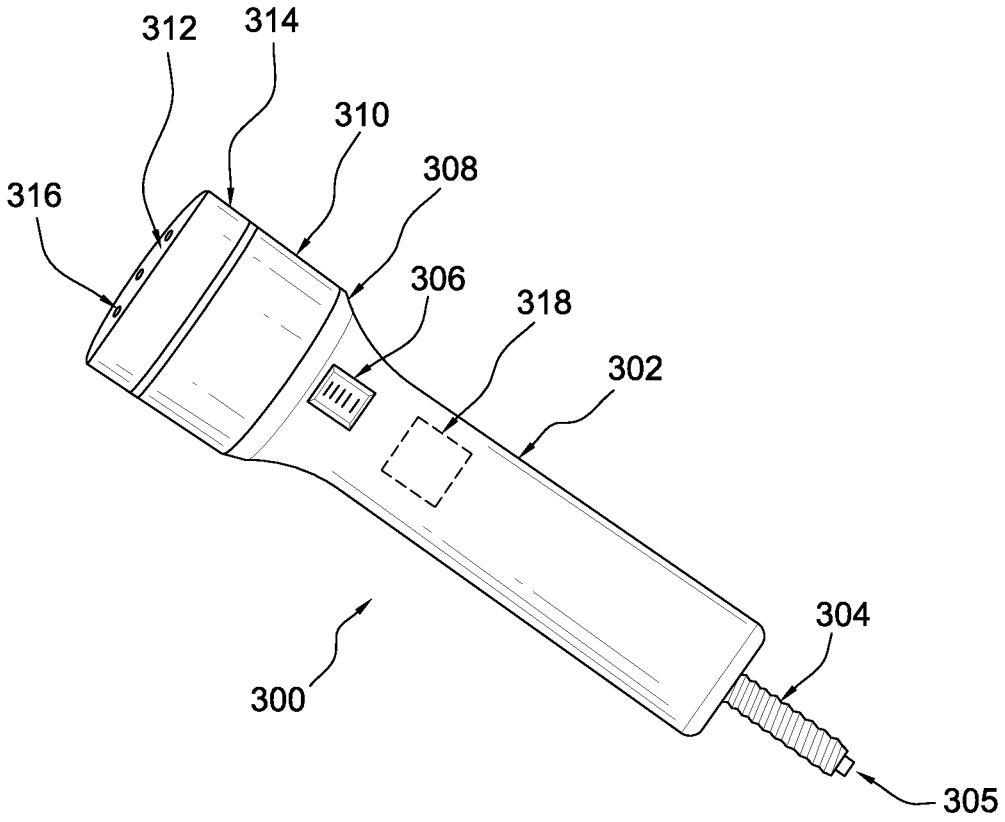
FIG. 3 shows a perspective view of an electrical or electronic accessory device in the form of a stabilizing light with optional wireless receiver according to various embodiments of the disclosed subject matter.

FIG. 3 shows a perspective view of an electrical or electric accessory device in the form of a stabilizing light 300 according to various embodiments of the disclosed subject matter. Stabilizing light 300 can be of any suitable configuration. Optionally, stabilizing light 300 can provide a light source. Optionally, the stabilizing light 300 can provide a means by which to stabilize the compound bow 100. Optionally, stabilizing light 300 can provide both, a light source and a means by which to stabilize the compound bow 100. The stabilizing light 300 shown in FIG. 3 can include, for example, a body 302, which can provide a battery storage facility and/or internal components for light operation; a threaded male connection 304, which can provide ground and may be hollow and provide insulation for a "hot" lead 305. Threaded male connection 304 can be configured to be threadedly coupled to stabilizer mounting port 110, thereby being placed in electrical connection with momentary switch 202 and/or cam switch 214. Stabilizing light 300 also can include an on/off switch 306, a pivoting connection 308 and pivoting head 310 for directional adjustment, a lens 312, a lens retainer 314, and a light emitting means 316, such as a light bulb, one or more LED, etc. The light emitting means 316 can output any suitable light, such as blue light, green light, red light, light for blood tracking, ultraviolet light, red night light, etc. Stabilizing light 300 also can include a wireless receiver 318 for wireless operation and/or control of the light 300. The wireless receiver 318 can be placed in any orientation inside the body 302, or alternatively can be coupled to the exterior of the light 300.

Typically, the stabilizing light 300 would attach to the stabilizing mounting port 110 of the compound bow 100. As mentioned earlier, in various embodiments, all or substantially all conductivity points can be integrated within the bow body, which can mean no or substantially no external wiring or cords.

When installed, the stabilizing light 300 can be operated by pressing the momentary switch 202, for example, and/or it can be operated by the cam switch 214 when tension is applied to the bow string 120 or when there is movement of the bow string 120, such as when a user draws back on the bow string 120. In various embodiments, the stabilizing light 300 can be functional to provide a light source when it is coupled to the stabilizer mounting port 110, or, in alternative embodiments, when not coupled thereto, since, in various embodiments the stabilizing light 300 can have its own power source (e.g., batteries). In the case where it is used while decoupled from the compound bow 100, on/off switch 306 can be used for controlling output of light. Stabilizing light 300 can be removed and replaced with a conventional stabilizer without alterations to the compound bow 100.

Figure 4:
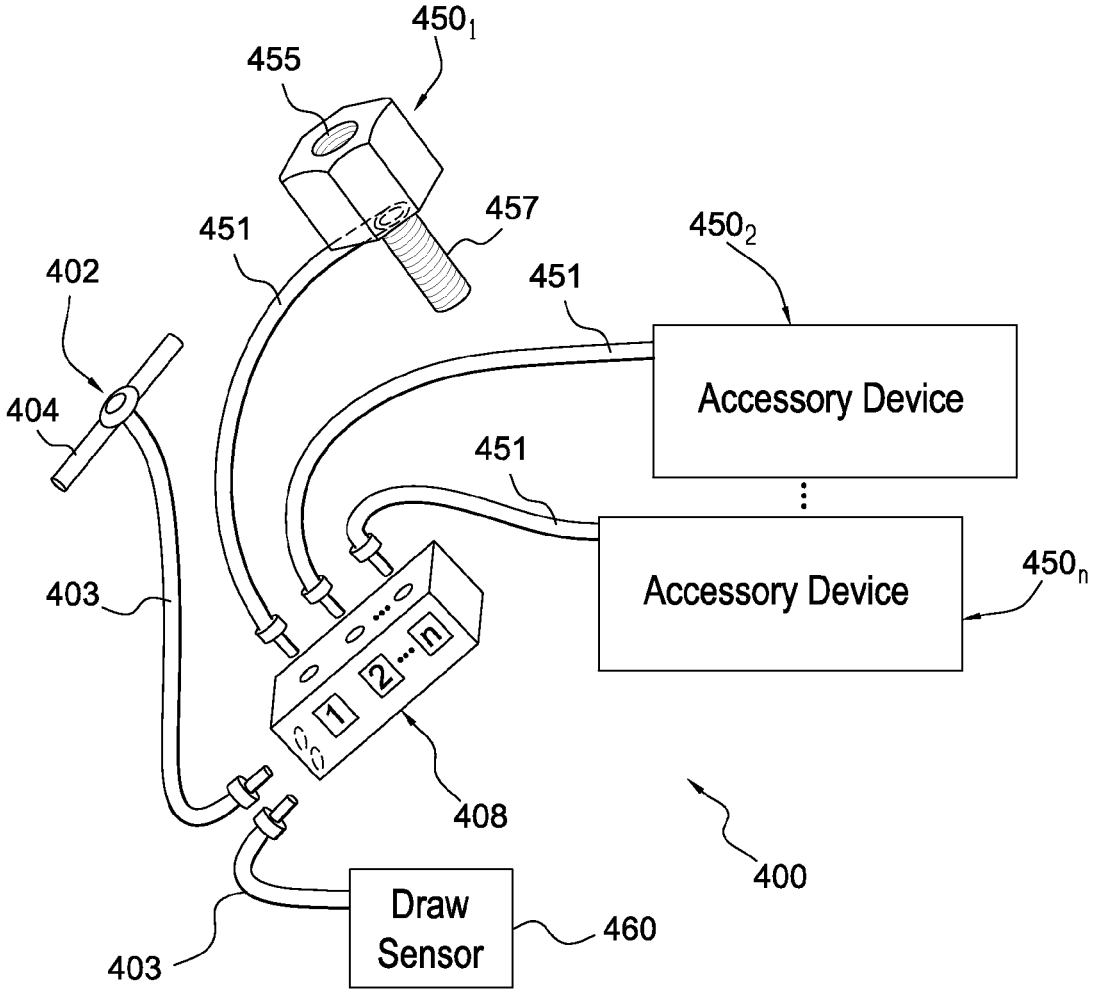
FIG. 4 is representation of a non-integral system for controlling various electronic or electrical accessory devices coupled to an archery apparatus according to various embodiments of the disclosed subject matter.

FIG. 4 is a representation of a non-integral system 400 for controlling various electronic or electrical accessory devices coupled to an archery apparatus according to various embodiments of the disclosed subject matter.

Generally speaking, the non-integral system 400 can function in the same manner as the integral system described above with respect to FIGS. 1, 2A and 2B. However, the system 400 is termed non-integral in the sense that some components can be "add-ons," coupled externally to any suitable compound bow (or any type of bow for that matter) after manufacture thereof. In particular, the system 400 is non-integral in the sense that selector 408 is not formed in one piece with the body of the compound bow 100, but rather, can be coupled to the body of the compound bow 100 after manufacture, for example, by the manufacturer itself, a retailer, or a retail customer. Optionally, momentary switch 402 and/or cam switch 214 also are not formed in one piece with the body of the compound bow 100 and can be coupled to the body of the compound bow after manufacture. Optionally, embodiments can include either one or the other of the selector 408 and momentary switch 402, or both the selector 408 and momentary switch 402. For example, momentary switch 402 can (1) plug directly into any electronic or electrical accessory device coupled to the body of the compound bow 100, or (2) can be routed through selector 408, which can allow one or multiple electronic or electrical accessory devices to be controlled or operated at one time or substantially simultaneously.

System 400 also is non-integral in the sense that an electrical connection or connections 403 (e.g., a connector wire, wires, or cabling) from momentary switch 402 and/or draw sensor 460 (e.g. cam switch 214) to the selector 408 (if implemented) or directly to an electrical or electronic accessory device coupled to the body of the compound bow is exposed. Similarly, respective electrical connections 451 from selector 408 to one or more of the electronic accessory devices $\mathbf{450}_{1\text{-}n}$ coupled to the body of the compound bow are exposed.

Momentary switch 402 can be removably coupled at any suitable position on the body of the bow, by any suitable means, such as at grip 108 via hook-and-loop fasteners 404, for example. Draw sensor 460 can be removably coupled to the body of the bow at any suitable position where tension or movement of the bow string 120 can occur indicating, for example, that the bow string 120 is being drawn, by any suitable means, such as at upper limb 104, for example. In terms of electrical functionality, momentary switch 402 can function substantially the same as momentary switch 202 described above, and draw sensor 460 can function substantially the same as cam switch 212 described above. Momentary switch 402 and/or draw sensor 460, however, can be configured for direct electrical connection to an electrical or electronic accessory device (for example, devices $\mathbf{450}_{1\text{-}n}$ in FIG. 4). The direct connection can be via exposed wiring or cabling 403. Alternatively, momentary switch 402 and/or draw sensor 460 can be routed through selector 408. Likewise, the electrical connection between these devices can be via exposed wiring or cabling 403.

Selector 408 can be removably coupled at any suitable position on the body of the bow, by any suitable means, such as below or above grip 108 via hook-and-loop fasteners, for example (not shown). In terms of electrical functionality, selector 408 functions substantially the same as selector 208 described above. Selector 408, however, can be configured for direct electrical connection from one or more electrical or electronic accessory devices (devices $\mathbf{450}_{1-n}$ in FIG. 4). The direct electrical connection can be provided via exposed wiring or cabling 451. In such case, some or all of mounting ports 204 and electrical ports 206 from FIGS. 1 and 2 may not be present. Selector 408 can be outfitted with any suitable number of ports (e.g., 1 through n, where 'n' is an integer) for connection to the momentary switch 402 and any suitable number of electronic or electrical accessory devices $\mathbf{450}_{1-n}$. These connections can be by way of quick-connect plugs, for example.

As an example of an electronic or electrical accessory device 450 for use in system 400, can be a female stabilizing coupling or boss $\mathbf{450}_1$ that is tapped 455 for receiving a stabilizer light (or a stabilizer) and configured with a threaded rod 457 such that it can be threaded into a stabilizer mounting port, such as that described above with respect to FIGS. 1 and 2. The female stabilizing coupling $\mathbf{450}_1$ also can be coupled directly to selector 408 via connection 451, or alternatively momentary switch 402 and/or draw sensor 460 (not explicitly shown).

In an alternative embodiment, draw sensor 460 can replace completely momentary switch 402. In other embodiments, selector 408 can be configured to route electrical connections to accessory devices to either one or both of the draw sensor 460 and momentary switch 402.

Figure 5:
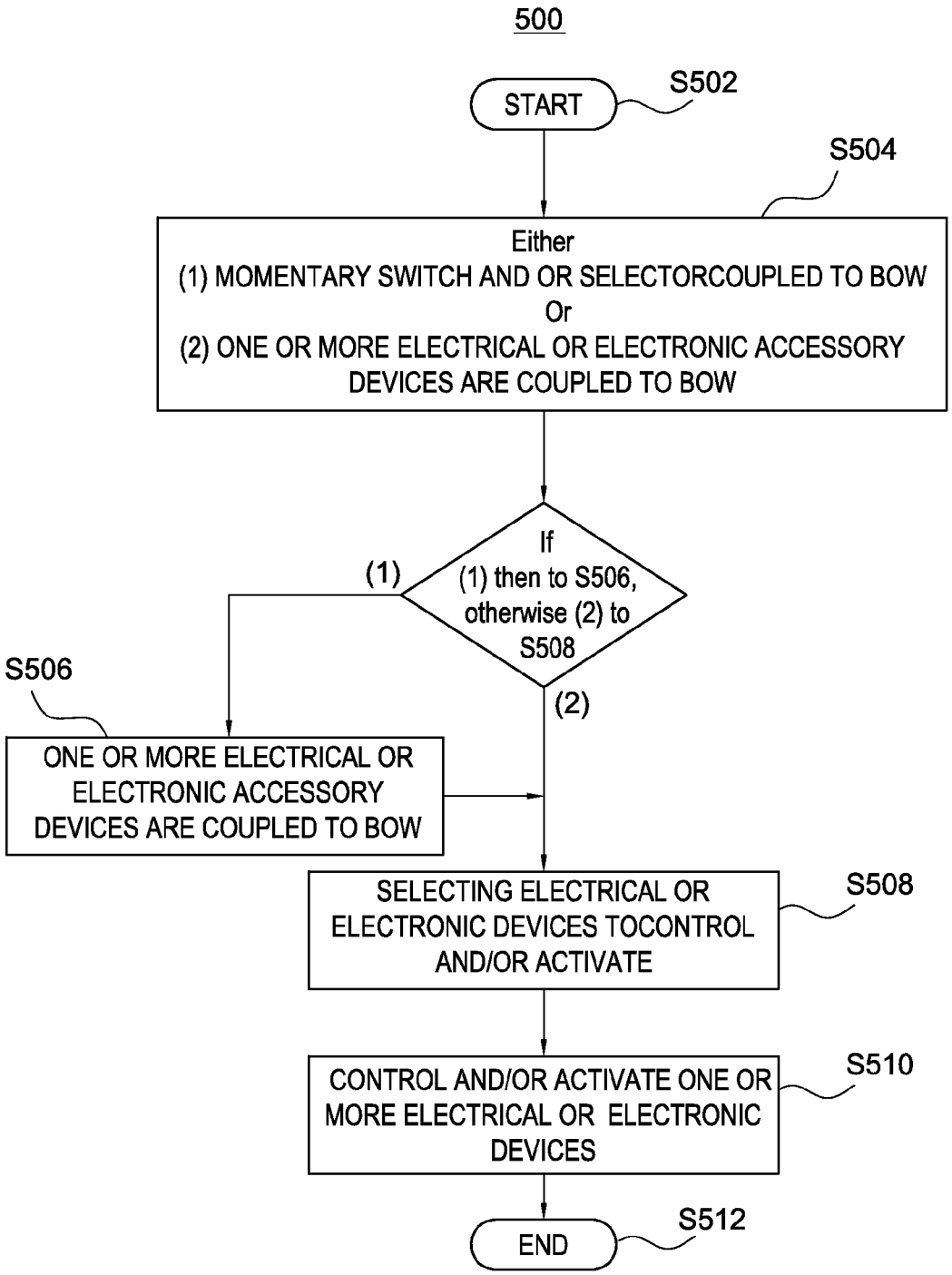
FIG. 5 is a flow chart of a method according to various embodiments of the disclosed subject matter.

FIG. 5 is a flow chart of a method 500 according to various embodiments of the disclosed subject matter.

Method 500 can begin at S502 and proceed to S504, whereby either (1) a momentary switch and/or a selector and/or a draw sensor such as cam switch 214 are coupled to the body of an archery apparatus; or (2) one or more electronic or electrical accessory devices are coupled to a momentary switch and/or a selector and/or a draw sensor of the archery apparatus. The one or more electronic or electrical accessory devices can be electrically coupled to the momentary switch and/or selector and/or a draw sensor. If (1), the method can proceed to S506, whereby one or more electronic or electrical accessory devices can be coupled to the momentary switch and/or a selector and/or a draw sensor. As discussed hereinabove, the one or more electronic or electrical accessory devices can be electrically coupled to the momentary switch and/or selector and/or a draw sensor. In either case, the method can then proceed to S508, whereby an optional step of setting, operating, or otherwise activating or using the selector (if optionally implemented) to select which electrical or electronic devices to control, operate, or activate. After either S506 or optional S508, at S510 the momentary switch and/or the draw sensor can be operated or activated to control or activate one or more electronic or electrical accessory devices coupled thereto or one or more electronic or electrical accessory devices selected using the selector. The method can then proceed to S512 where the method ends.

In at least one embodiment, the method can include wireless operation (i.e., control and/or activation). Optionally, for wireless operation of such embodiments, the method can include performing a device discovery operation to identify electrical or electronic accessory devices coupled to receptacles of the bow or in proximity to the bow, prior to operating an electronic control device of wireless type to control and/or activate the electronic or electrical accessory devices discovered (either presently or previously). In various embodiments, the device discovery operation can be performed automatically upon activation of the momentary switch and/or the draw sensor. Alternatively, the device discovery operation can be performed automatically, continuously, and/or periodically.

Figure 6:
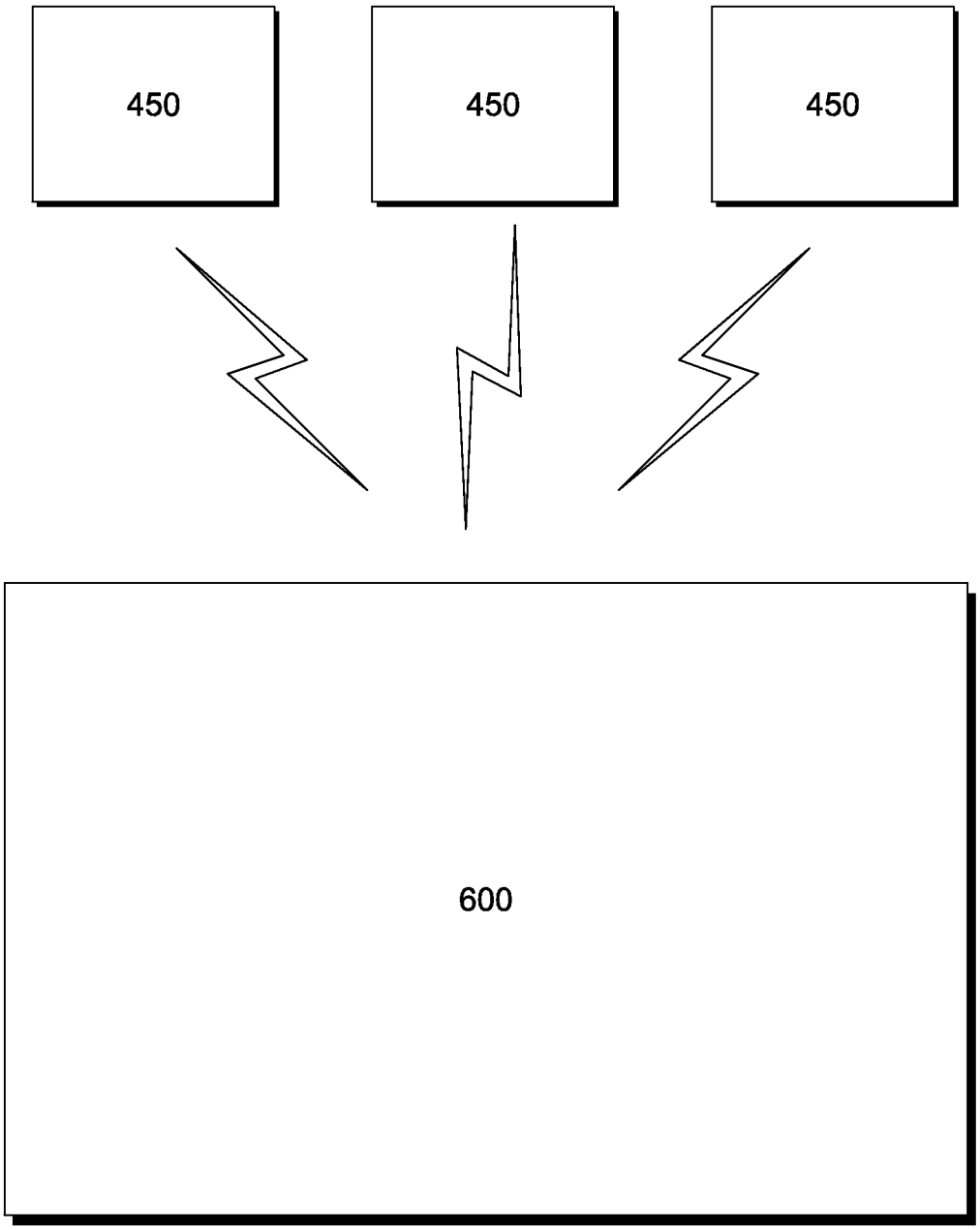
FIG. 6 is block diagram of an electronic control device and electrical or electronic accessory devices for wireless communication therebetween according to various embodiments of the disclosed subject matter.

FIG. 6 is block diagram of an electronic control device 600 and electrical or electronic accessory devices 450 as described herein. As shown in FIG. 6, wireless communication can occur between electronic control device 600 and one or more of the electrical or electronic accessory devices 450 coupled to or otherwise in relative proximity to the electronic control device 600. In various embodiments, the electronic control device 600 can include a wireless transmitter for communicating (i.e., transmitting) wireless signals to receivers associated with the aforementioned electrical or electronic accessory devices 450 coupled to or otherwise in relative proximity to the electronic control device 600. In various embodiments, some or all of the electrical or electronic accessory devices 450 may not be physically connected to a bow or other archery apparatus at all in order to be controlled and/or activated. Electronic control device 600 can be either substantially permanently or temporarily affixed to an archery apparatus, such as bow 100 shown in FIG. 1. The electronic device 600 can wirelessly communicate with respective wireless receivers associated with the one or more electrical or electronic accessory devices 450 to control and/or activate the accessory devices 450. The wireless communication can be of any suitable format, such as by radio frequency ("RF") or by infrared ("IR") signals of any suitable type, frequency, or modulation, such as frequency modulation ("FM"), SSB, etc. Furthermore, in various embodiments, each electronic or electrical accessory device 450 can be operated wirelessly via a unique control frequency. In various embodiments, the electronic control device 600 can control power supplied to the aforementioned electrical or electronic accessory devices 450. Optionally, power supplied to the electrical or electronic accessory devices 450 can be provided by power supplies located on the electrical or electronic accessory devices 450 themselves.

In various embodiments, the electronic control device 600 can include momentary switch 202 and/or selector 208 and/or cam switch 214 (not explicitly shown in FIG. 6). In the case of an electronic control device 600 comprised of a momentary switch, such as momentary switch 202, a draw sensor, such as cam switch 214, and a selector, such as selector 208, the momentary switch can include a wireless transmitter (e.g., an RF or IR transmitter), the draw sensor can include a wireless transmitter (e.g., an RF or IR transmitter), and the selector can include a wireless transceiver (e.g., an RF or IR transceiver). In such embodiments, the momentary switch and the selector can communicate wirelessly with each other via the wireless transmitter and transceiver to control and/or activate one or more electrical or electronic accessory devices 450 based on a user input, and the draw sensor and the selector can communicate wirelessly with each other via the wireless transmitter and transceiver to control and/or activate one or more electrical or electronic accessory devices 450 when a user draws back on the bow string 120; the momentary switch and/or the draw sensor and/or the selector can communicate wirelessly with wireless receivers (e.g., an RF or IR receiver) of the one or more electrical or electronic accessory devices 450. For example, in various embodiments, the selector can be set or otherwise used to selectively control wireless communication from the momentary switch for one or more electronic or electrical accessory devices 450 and to selectively control wireless communication from the draw sensor for one or more electronic or electrical accessory devices 450. Thus, in this example, one or more of the electronic or electrical accessory devices 450 can be selectively activated (e.g., power turned on) based on the configuration of the selector. Optionally, wireless communication can be provided by the momentary switch and/or the draw sensor directly to the one or more electronic devices 450 based on the configuration of the selector. Optionally or alternatively, the one or more electronic accessory devices 450 can receive wireless communication from the selector based on wireless communication from the transmitter of the momentary switch and/or the draw sensor.

Optionally, the electronic control device 600 can perform a device discovery operation to identify electrical or electronic accessory devices 450 coupled to receptacles or in proximity thereto. In various embodiments the device discovery operation is performed automatically. Optionally, the device discovery operation is performed automatically, continuously, and/or periodically.

Figure 7:
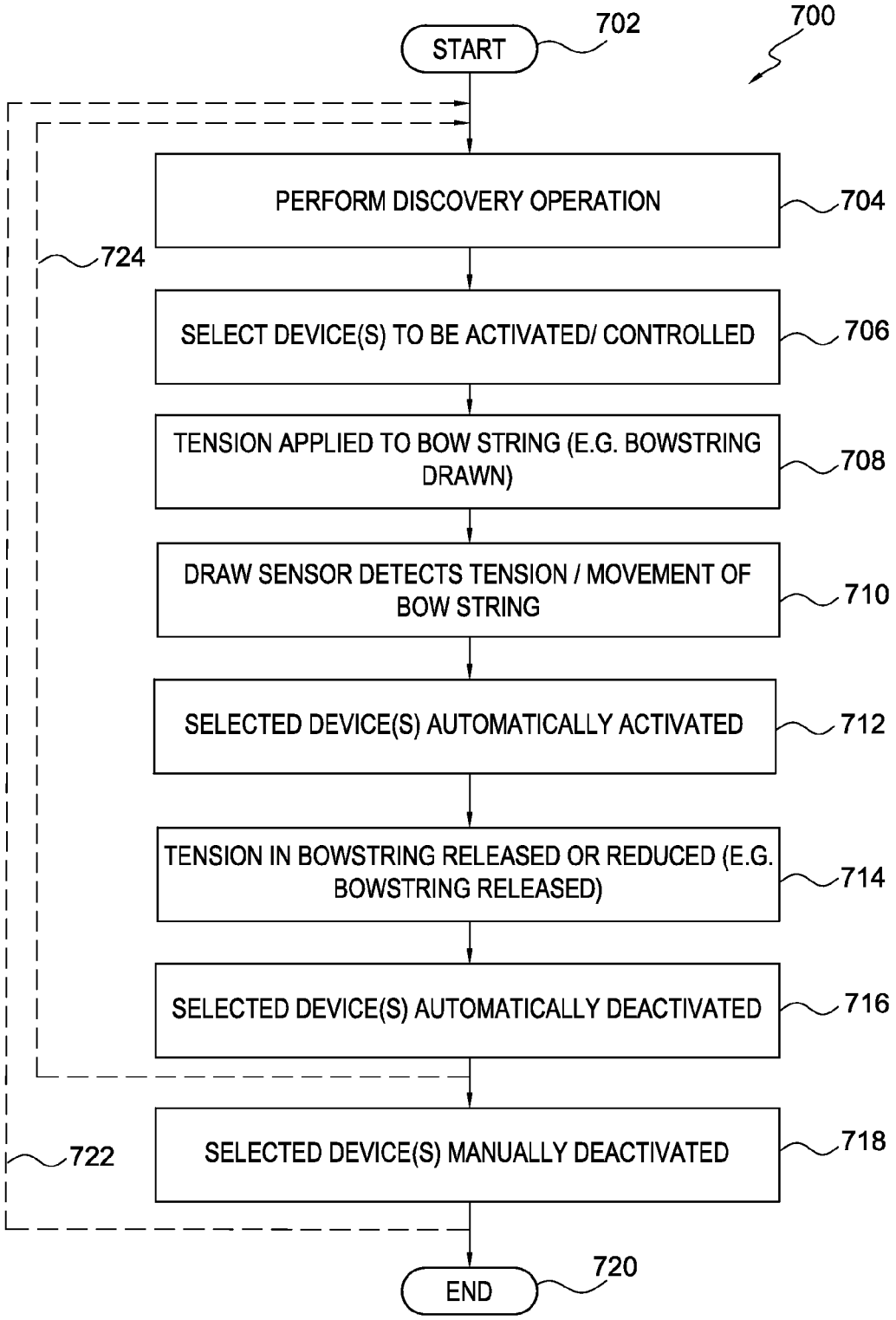
FIG. 7 is a flow chart of a method according to various embodiments of the disclosed subject matter.

FIG. 7 is a flow chart of a method 700 according to various embodiments of the disclosed subject matter.

Method 700 can begin at 702 and proceed to 704, whereby a discovery operation is performed to identify electrical or electronic accessory devices coupled to receptacles or in proximity to the compound bow. As discussed herein, the discovery operation can be performed to identify wireless electrical or electronic accessory devices of the bow.

The method can proceed to 706, whereby one or more electronic or electrical accessory devices can be coupled to the momentary switch and/or a cam switch (draw sensor) and/or a selector. As discussed herein, the one or more electronic or electrical accessory devices can be electrically coupled to the momentary switch and/or cam switch and/or selector. This can also include setting, operating, or otherwise activating or using the selector (if optionally implemented) to select which electrical or electronic devices to control, operate, or activate.

The method can proceed to 708, whereby tension is applied to the bow string or when the bow string moves, for example when a user draws back on the bow string.

The method can proceed to 710, whereby the cam switch can be operated or activated in response to tension being applied to the bow string, for example when a user draws back on the bow, whereby the method then proceeds to 712 where one or more electronic or electrical accessory devices coupled thereto or one or more electronic or electrical accessory devices selected using the selector are automatically controlled and/or activated.

The method can then proceed to 714 where the tension in the bow string is released or reduced, whereby the method can then proceed to 716 where the cam switch is deactivated in response to the tension being released or reduced, and zero or more of the devices previously automatically activated at 712 are automatically deactivated. As discussed herein, automatic deactivation can be immediate or after a predetermined period of time, and some devices may remain activated until manually deactivated by the user.

The method can proceed to 718 where the user can manually deactivate one or more of the devices that remain activated. For example, a light and video camera coupled to or in proximity to the bow may remain activated to film a hunt until manually deactivated, while a sight light and/or stabilizing light may be automatically deactivated after a projectile is fired. In some embodiments the user can manually deactivate a device that remains activated by using the momentary switch and/or selector as described hereinabove.

The method can proceed to 720, where the method ends. It will be appreciated that the method can be repeated in whole or in part, as indicated at 722 and 724, respectively.

FIGS. 8A, 8B, and 8C show various views of a draw sensor in the form of a cam switch according to various embodiments of the disclosed subject matter. Like elements in these figures have been identified using the same reference numerals.

FIG. 8A is a front view of a draw sensor in the form of a cam switch 800 according to various embodiments of the disclosed subject matter. Cam switch 800 can comprise a body 802 including a reed switch 804. The body 802 of cam switch 800 can be coupled to the bow 100 using a layer of adhesive 806, for instance, at the upper limb 104 as shown in FIGS. 1 and 2B.

FIG. 8B is a side view of a draw sensor in the form of a cam switch 800 with wireless transmitter 808 according to various embodiments of the disclosed subject matter. As shown in FIG. 8A, cam switch 800 can comprise a body 802 including a reed switch 804 and can be coupled to the bow 100 using a layer of adhesive 806. The body 802 can include a wireless transmitter 808 coupled to the reed switch 804.

In operation, reed switch 804 is normally open when the bow string 120 is in a resting position and when tension is applied to the bow string 120 and/or the bow string 120 is moved, such as when a user draws back on the bow string 120, a magnet, such as magnet 212 shown in FIG. 2B coupled to the cam 118 or idler wheel 116, rotates causing a magnetic field to rotate away from the normally open reed switch 804 which then closes to activate the wireless transmitter 808 to wirelessly activate and/or control one or more electrical or electronic accessory devices coupled to or otherwise in relative proximity to the bow 100. In such operation, the reed switch 804 circuit will remain closed until the bow string 120 is released and the magnetized cam or idler wheel and bow string 120 return to their resting position which causes the reed switch 804 circuit to open.

FIG. 8C is a side view of a draw sensor in the form of a cam switch 850 with wired electrical connections 810 and 812 according to various embodiments of the disclosed subject matter. Cam switch 850 can comprise a body 852 including a reed switch 804 and can be coupled to the bow 100 using a layer of adhesive 806. Electrical connections 810 and 812 (e.g., connector wire, wires, or cabling) can electrically connect reed switch 804 to one or more electrical or electronic accessory devices coupled to or otherwise in relative proximity to the bow 100. In some embodiments, electrical connections 810 and 812 can electrically connect reed switch 804 to a selector, such as selector 408 shown in FIG. 4. In various embodiments, electrical connections 810 and 812 can integral with the body of bow 100 to connect reed switch 804 to integrated accessory devices such as but not limited to an integrated sight light such as integrated sight lights 1000 and 1050, shown in FIGS. 10A and 10B, respectively, and an integrated sight such as integrated sight 1102 shown in FIGS. 11 and 12.

Cam switch 850 operates in manner similar to cam switch 800 in FIG. 8B. In operation, the reed switch 804 of cam switch 850 is normally open when the bow string 120 is in a resting position, and when tension is applied to the bow string 120 and/or the bow string 120 is moved, such as when a user draws back on the bow string 120 a magnet, such as magnet 212, rotates causing a magnetic field to rotate away from the normally open reed switch 804 which then closes to activate and/or control one or more electrical or electronic accessory devices electrically connected to reed switch 804 via electrical connections 810 and 812 and coupled to or otherwise in relative proximity to the bow 100. In such operation, the reed switch 804 circuit will remain closed until the bow string 120 is released and the magnet and bow string 120 return to their resting position which causes the reed switch 804 circuit to open.

Figure 9:
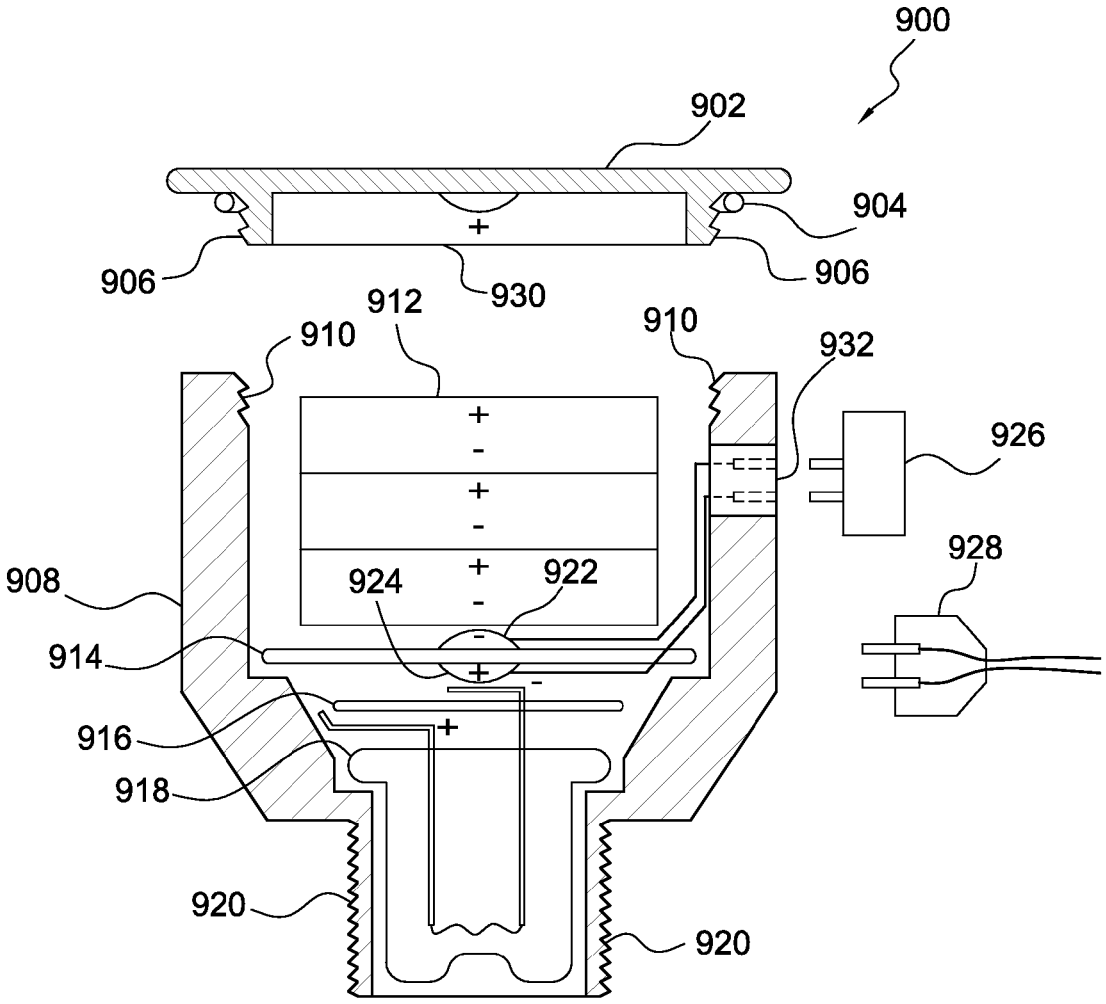
FIG. 9 is a cross-sectional view of an electrical or electronic accessory device in the form of a switched sight light with wireless receiver or wired connector according to various embodiments of the disclosed subject matter.

FIG. 9 is a cross-sectional view of an electrical or electronic accessory device in the form of a switched sight light 900 with wireless receiver 926 or wired connector 928 according to various embodiments of the disclosed subject matter. Switched sight light 900 can be of any suitable configuration. Optionally, switched sight light 900 can provide a light source. The switched sight light 900 shown in FIG. 9 can include, for example, a body 908, which can provide a battery storage facility and/or internal components for light operation such as a top 902 (comprising O-ring 904, top threaded male connector 906, and battery contact 930), threaded female connector 910, batteries 912, battery contact 922, isolation 914, bulb contact 914, isolation 916, and a light emitting means 918 such as a light emitting diode (LED); a threaded male connection 920, which can provide ground and may be hollow and may provide insulation for a "hot" lead; and a female plug 932.

Female plug 932 can be configured to be coupled to wireless receiver 926 or wired connector 928, thereby being placed in electrical connection with momentary switch 202 and/or cam switch 214. The light emitting means 918 can output any suitable light, such as blue light, green light, red light, light for blood tracking, ultraviolet light, red night light, etc.

When coupled to wired connector 928, in various embodiments, as mentioned earlier, all or substantially all conductivity points can be integrated within the bow body, which can mean no or substantially no external wiring or cords.

When installed, the switched sight light 900 can be operated by pressing the momentary switch 202, for example, and/or it can be operated by the cam switch 214 when tension is applied to the bow string 120 and/or the bow string 120 is moved, such as when a user draws back on the bow string 120. In various embodiments, the switched sight light 900 can be functional to provide a light source when it is coupled to the bow 100, or, in alternative embodiments, when not coupled thereto, since, in various embodiments the switched sight light 900 can have its own power source (e.g., batteries). Switched sight light 900 can be removed and replaced with a conventional light source without alterations to the compound bow 100.

In various embodiments, the switched sight light 900 shown in FIG. 9 can attach to a mounting port of bow 100 and can be attached in a similar manner as stabilizing light 300 shown in FIG. 3.

Figure 10A:
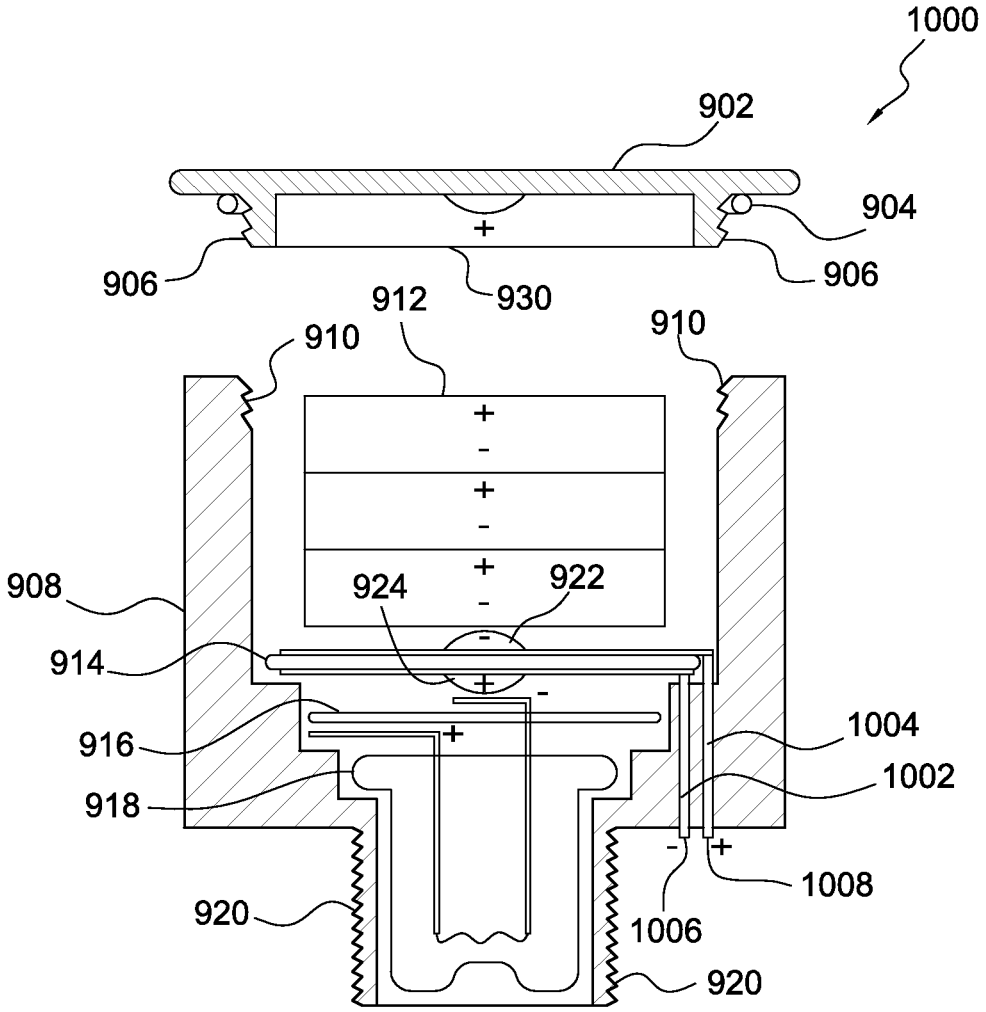
FIG. 10A is a cross-sectional view of an electrical or electronic accessory device in the form of an integrated sight light with contact points for an integrated sight according to various embodiments of the disclosed subject matter.

FIG. 10A is a cross-sectional view of an electrical or electronic accessory device in the form of an integrated sight light 1000 with contact points 1006 and 1008 for an integrated sight according to various embodiments of the disclosed subject matter. Integrated sight light 1000 can be of any suitable configuration. Optionally, integrated sight light 1000 can provide a light source. Integrated sight light 1000 can include elements similar to those of switched sight light 900 shown in FIG. 9 and like elements in these figures have been identified using the same reference numerals.

The integrated sight light 1000 shown in FIG. 10A can include, for example, a body 908, which can provide a battery storage facility and/or internal components for light operation such as a top 902 (comprising O-ring 904, top threaded male connector 906, and battery contact 930), threaded female connector 910, batteries 912, battery contact 922, isolation 914, bulb contact 914, isolation 916, and a light emitting means 918 such as a light emitting diode (LED); a threaded male connection 920, which can provide ground and may be hollow and may provide insulation for a "hot" lead; insulated contacts 1002 and 1004, and contact points 1006 and 1008.

Figure 11:
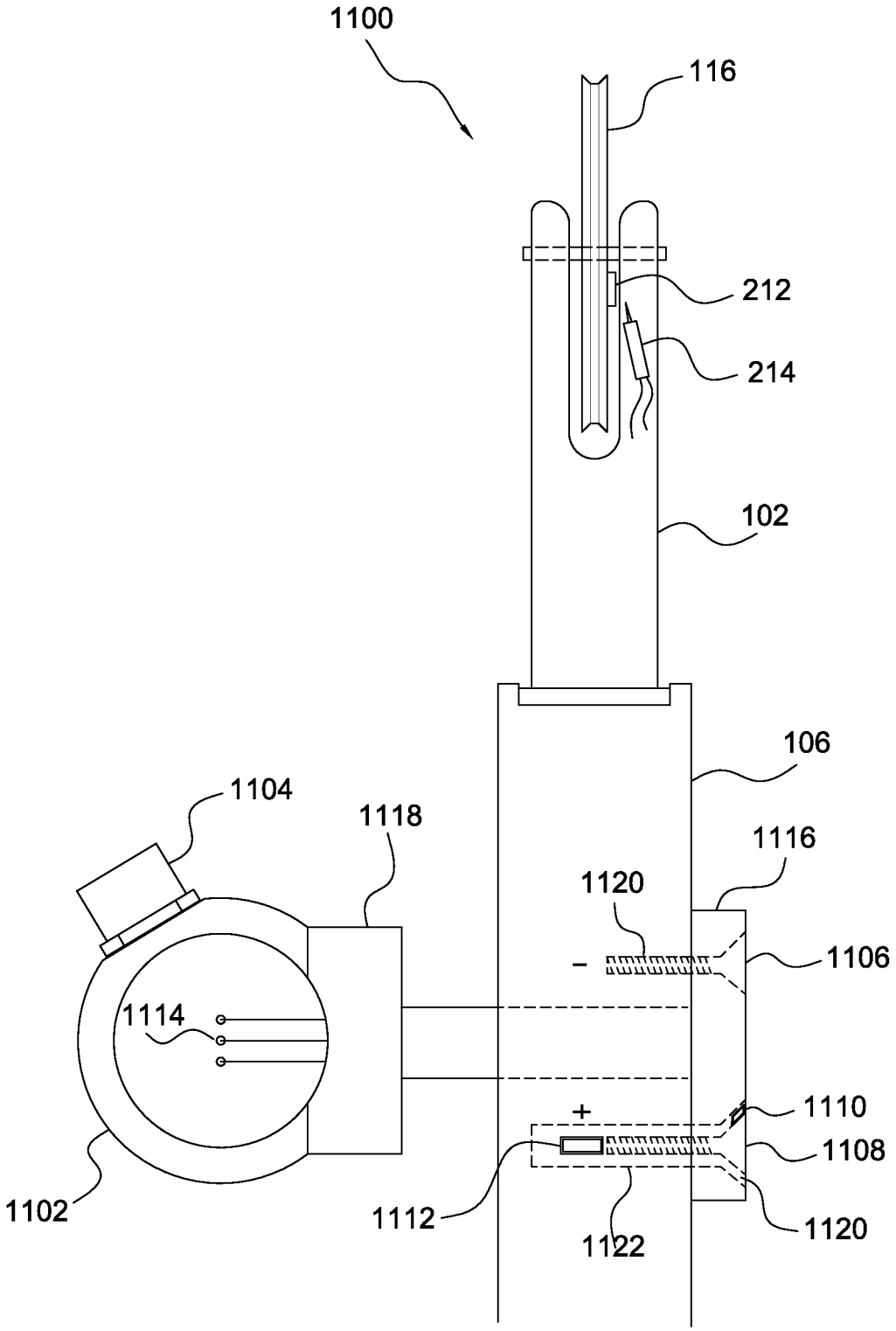
FIG. 11 is a front view drawing of a compound archery bow including an integrated sight and integrated sight light according to various embodiments of the disclosed subject matter.

Contact points 1006 and 1008 can be configured to place integrated sight light 1000 in electrical connection with momentary switch 202 and/or cam switch 214 when threaded male connection 920 is threadedly coupled to an integrated sight such as that shown in FIGS. 11 and 12. The light emitting means 918 can output any suitable light, such as blue light, green light, red light, light for blood tracking, ultraviolet light, red night light, etc.

When installed, the integrated sight light 1000 can be operated by pressing the momentary switch 202, for example, and/or it can be operated by the cam switch 214 when tension is applied to the bow string 120 and/or the bow string 120 is moved, such as when a user draws back on the bow string 120. In various embodiments, the integrated sight light 1000 can be functional to provide a light source when it is coupled to the bow 100, or, in alternative embodiments, when not coupled thereto, since, in various embodiments the integrated sight light 1000 can have its own power source (e.g., batteries 912). Integrated sight light 1000 can be removed and replaced with a conventional light source without alterations to the compound bow 100.

In various embodiments, the integrated sight light 1000 shown in FIG. 10A can attach to an integrated sight such as that shown in FIGS. 11 and 12.

Figure 10B:
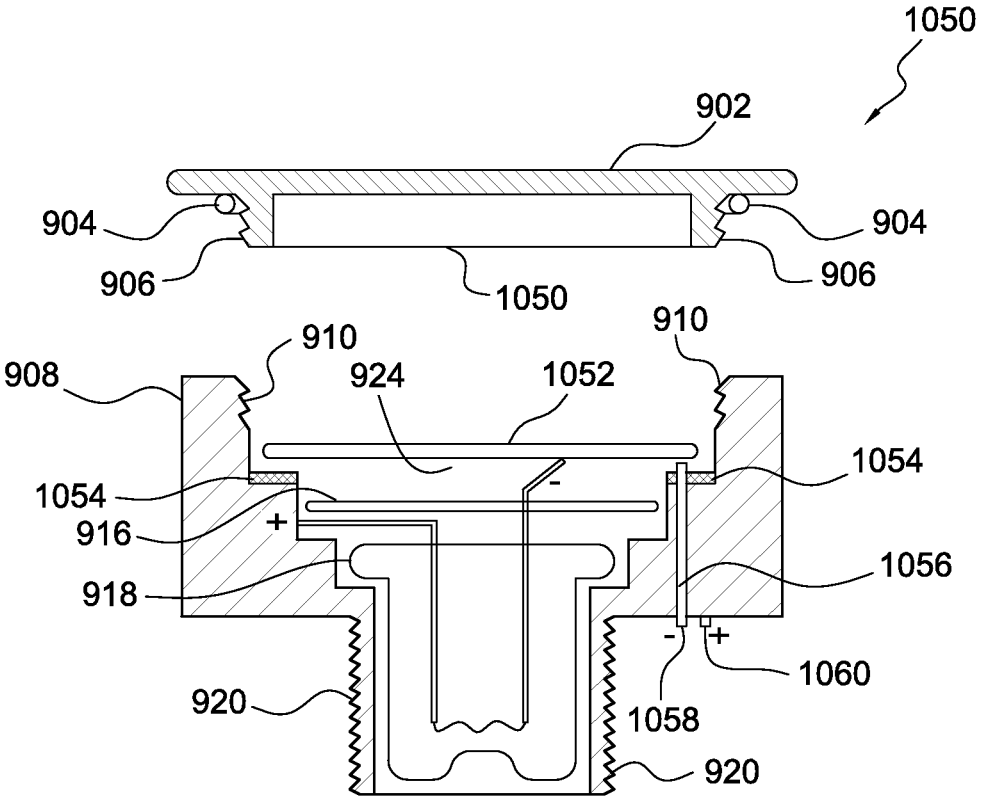
FIG. 10B is a cross-sectional view of an electrical or electronic accessory device in the form of an externally powered integrated sight light with contact points for an integrated sight according to various embodiments of the disclosed subject matter.

FIG. 10B is a cross-sectional view of an electrical or electronic accessory device in the form of an externally powered integrated sight light 1050 with contact points 1058 and 1060 for an integrated sight according to various embodiments of the disclosed subject matter. Integrated sight light 1050 can include elements similar to those of switched sight light 900 and integrated sight light 1050 shown in FIGS. 9 and 10A, respectively, and like elements in these figures have been identified using the same reference numerals.

Integrated sight light 1050 can be of any suitable configuration. Optionally, integrated sight light 1050 can provide a light source. The integrated sight light 1050 shown in FIG. 10B can include, for example, a body 908, which can provide internal components for light operation such as a top 902 (comprising O-ring 904, top threaded male connector 906, and a foam layer 1050), threaded female connector 910, isolation 1054, isolation 916, a light emitting means 918 such as a light emitting diode (LED), and a conductive disc 1052; a threaded male connection 920, which can provide ground and may be hollow and may provide insulation for a "hot" lead; contact points 1058 and 1060, and an insulated contact 1054 which can provide electrical connection between the contact points 1058 and 1060 and the conductive disc 1052 which can provide an electrical connection to the light emitting means 918.

Contact points 1058 and 1060 can be configured to place integrated sight light 1050 in electrical connection with momentary switch 202 and/or cam switch 214 when threaded male connection 920 is threadedly coupled to an integrated sight such as that shown in FIGS. 11 and 12. The light emitting means 918 can output any suitable light, such as blue light, green light, red light, light for blood tracking, ultraviolet light, red night light, etc.

When installed, the integrated sight light 1050 can be operated by pressing the momentary switch 202, for example, and/or it can be operated by the cam switch 214 when tension is applied to the bow string 120 and/or the bow string 120 is moved, such as when a user draws back on the bow string 120.

In various embodiments, the integrated sight light 1050 can be functional to provide a light source when it is coupled to the bow 100, or, in alternative embodiments, when not coupled thereto, since, in various embodiments the integrated sight light 1050 can have its own power source (e.g., batteries 912). Integrated sight light 1050 can be removed and replaced with a conventional light source without alterations to the compound bow 100.

In various embodiments, the integrated sight light 1050 shown in FIG. 10B can attach to an integrated sight such as that shown in FIGS. 11 and 12.

FIG. 11 is a front view drawing of an upper portion of a compound archery bow 1100 including an integrated sight 1102 and integrated sight light 1104 according to various embodiments of the disclosed subject matter. Compound archery bow 1100 can include a body 106, an upper limb 102, an idle wheel 116, a magnet 212, and a cam switch 214 as shown in FIGS. 1, 2A, and 2B and described above. Compound archery bow 1100 can include an integrated sight 1102 including a body 1118 coupled to a mounting bracket 1116 that includes a grounding fastener hole 1106 and a contact fastener hole 1108 with an integrated insulated electrical contact 110. Integrated sight 1102 can also include sight pins 1114 and can also have an integrated sight light 1104 attached, such as the integrated sight lights 1000 and 1050 shown in FIGS. 10A and 10B, respectively. The body 106 of compound archery bow 1100 can include a grounding fastener hole 1120 and a contact fastener hole 1122 including an insulated electrical contact 1112.

Integrated sight 1102 can be attached to the body 106 of compound archery bow 1100 using conducting fasteners, such as, for example, metallic counter sunk screws (not shown), such that one fastener attaches through grounding fastener hole 1106 and grounding fastener hole 1120 which can ground integrated sight 1102 to the bow and/or riser, and another conducting fastener attaches through contact fastener hole 1108 and contact fastener hole 1122 which can electrically connect insulated contact 1110 and insulated contact 1112. Compound archery bow 1100 can be configured to provide an electrical connection between the cam switch 214 and insulated contact 1112, such that when the integrated sight 1102 is attached as described above, an electrical connection is provided between the cam switch 214 and the integrated sight 1102. Optionally, compound archery bow 1100 can be configured to provide an electrical connection between the momentary switch 202 and insulated contact 1112, such that when the integrated sight 1102 is attached as described above, an electrical connection is provided between the momentary switch 202 and the integrated sight 1102.

In operation, the cam switch 214 and/or the momentary switch 202 and/or the selector 208 can activate and/or control the integrated sight light 1104. In some embodiments, the cam switch 214 can activate and/or control the integrated sight light 1104 when tension is applied to the bow string 120 (not pictured in FIG. 11) and/or the bow string 120 is moved, such as when a user draws back on the bow string 120.

The integrated sight light 1104 can be powered by internal batteries as shown in FIG. 10A or, optionally and/or alternatively, by a power source (not shown) internal to the compound archery bow 1100. It will be appreciated that although not explicitly shown, integrated sight light 1104 can be configured to be powered by both a power source internal to the integrated sight light 1104 (such as batteries shown in FIG. 10A) and a power source external to the integrated sight light 1104 (as shown in FIG. 10B) and internal or external to the compound archery bow 1100; and either power source being a main power source and the other power source acting as a backup power source to be used when the main power source cannot provide the necessary power.

Figure 12A:
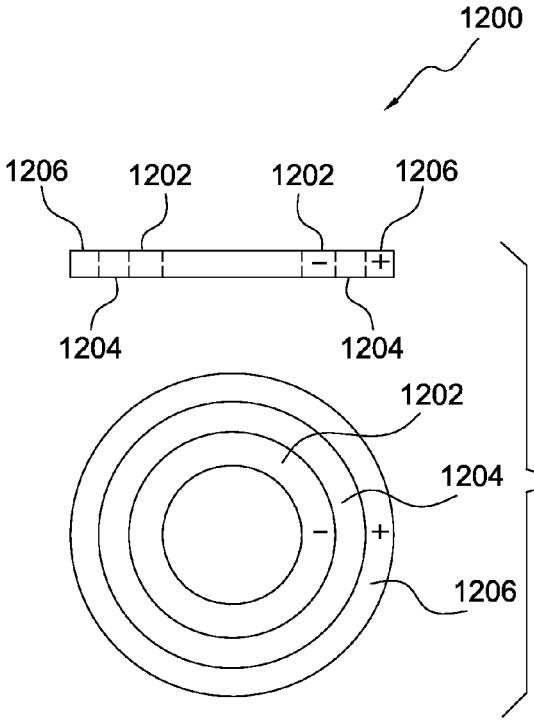
FIG. 12A is a side view drawing of an integrated sight and integrated sight light according to various embodiments of the disclosed subject matter.
Figure 12B:
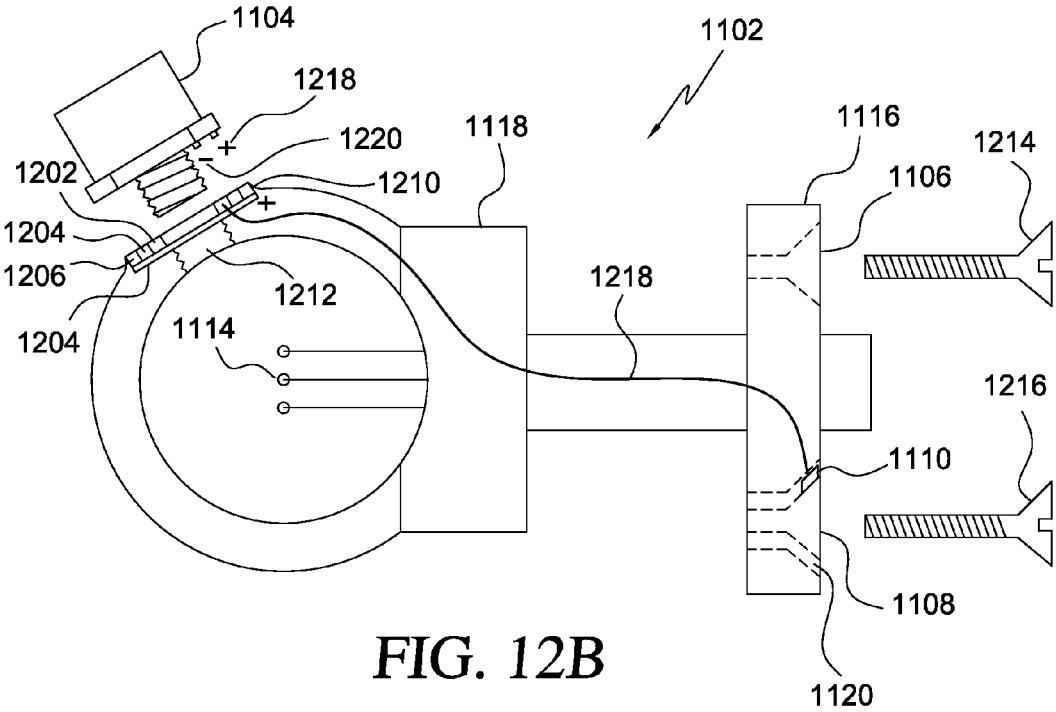
FIG. 12B is a front view drawing of an integrated sight and integrated sight light according to various embodiments of the disclosed subject matter.

FIGS. 12A and 12B are side and front view drawings, respectively, of an integrated sight 1102 and integrated sight light 1104 according to various embodiments of the disclosed subject matter. Integrated sight 1102 can include elements similar to those of shown in FIG. 11 and like elements in these figures have been identified using the same reference numerals.

Integrated sight 1102 can include a body 1118 coupled to a mounting bracket 1116 that includes a grounding fastener hole 1106 and a contact fastener hole 1108 with an integrated insulated electrical contact terminal 1110. Contact fastener hole 1108 can include isolation 1120. Grounding fastener hole 1106 can be configured without isolation. Conductive fasteners 1214 and 1216 can be used to attach integrated sight 1102 to a bow such as the compound archery bow 1100 shown in FIG. 11 and described hereinabove.

Integrated sight 1102 can include a female threaded connector 1212, and integrated sight light 1104, such as the integrated sight lights 1000 and 1050 shown in FIGS. 10A and 10B, respectively, can be threadly coupled to integrated sight 1102 at the female threaded connector 1212. Integrated sight 1102 can include an inner contact 1202, isolation 1204, and an outer contact 1206 which can be configured to provide an electrical connection between the integrated sight 1102 and integrated sight light 1104.

Integrated sight light 1104 can include contact points 1218 and 1220 (such as the contact points 1006/1008 and 1058/1060 of FIGS. 10A and 10B, respectively), which can electrically connect integrated sight light 1104 to insulated contact terminal 1110 when the integrated sight light 1104 is threadly coupled to the integrated sight 1102 and the contact points 1218 and 1220 are connected to outer contact 1206 and inner contact 1202, respectively. Integrated sight 1102 can include an insulated integrated lead 1218 which can be integral to integrated sight 1102 and which can provide an electrical connection between the outer contact 1206 and/or inner contact 1202 and the integrated insulated electrical contact terminal 1110. Optionally, the outer contact 1206 can be grounded to the integrated sight body 1118.

In various embodiments, integrated sight light 1104 can be electrically connected to the cam switch 214 and/or momentary switch 202 and/or selector 208 (not shown) when integrated sight 1102 is attached to the body or riser of bow 100 as described in FIG. 11. Activation and/or operation of integrated sight light 1104 can be performed by the cam switch 214 and/or momentary switch 202 and/or selector 208 as described hereinabove.

While the invention(s) has/have been described in conjunction with a number of embodiments, it is evident that many alternatives, modifications and variations would be or are apparent to those of ordinary skill in the applicable arts. Accordingly, Applicant intends to embrace all such alternatives, modifications, equivalents, and variations that are within the spirit and scope of the invention(s) described herein.

What is claimed is:

1. A compound archery bow comprising:

a bow string; and an elongate body operatively coupled to the bow string, the body including a draw sensor, an integrated selector, a grip portion having an integrated momentary switch, and a plurality of accessory attachment ports, wherein the draw sensor includes a wireless transmitter, wherein the momentary switch includes a wireless transmitter, wherein the selector includes a wireless transceiver, wherein the draw sensor and the selector are configured to communicate wirelessly with each other via the transmitter and transceiver, wherein the momentary switch and the selector are configured to communicate wirelessly with each other via the transmitter and transceiver, wherein the selector is configured to selectively control wireless communication from the draw sensor for one or more electronic accessory devices mechanically coupled to respective accessory attachment ports, wherein the selector is configured to selectively control wireless communication from the momentary switch for one or more electronic accessory devices mechanically coupled to respective accessory attachment ports, wherein the draw sensor is configured to activate one or more of the electronic accessory devices mechanically coupled to respective accessory attachment ports based on the selective control of the selector, and wherein the momentary switch is configured activate one or more of the electronic accessory devices mechanically coupled to respective accessory attachment ports based on the selective control of the selector.

2. The compound archery bow of claim 1, wherein said one or more electronic accessory devices each include a receiver to receive wireless communication from the compound archery bow.

3. The compound archery bow of claim 2, wherein said one or more electronic accessory devices receive wireless communication from the selector based on communication from the transmitter of the draw sensor.

4. The compound archery bow of claim 2, wherein said one or more electronic accessory devices receive wireless communication from the transmitter of the draw sensor based a selection configuration of the selector.

5. The compound archery bow of claim 1, wherein the selector includes visual indicators to indicate selective control of the one or more electronic accessory devices.

6. The compound archery bow of claim 1, wherein the draw sensor is configured to be activated when the bow string is drawn back by a user of the bow.

7. The compound archery bow of claim 1, wherein the electronic accessory devices include at least one of a light, a sight light, a stabilizing light, a spot light, a video device, a photographic device, an audio enhancement device, a reel device, a game calling device, a range finder device, a sighting device, and a lighted quiver device.

8. The compound archery bow of claim 1, wherein, upon activation, power to the one or more electronic accessory devices mechanically coupled to respective accessory attachment ports based on the selective control of the selector is provided from one or more respective power sources of the one or more electronic accessory devices.

9. The compound archery bow of claim 1, wherein the selector is configured to allow none, only one, only some, or all electronic accessory devices to be operated at one time, with each said electronic accessory device having a unique control frequency or code associated therewith.

10. The compound archery bow of claim 1, wherein the body includes an integrated stabilizer mounting port, and wherein the electronic accessory devices include a stabilizing light, the stabilizer mounting port being configured to be mechanically coupled to the stabilizing light, and the stabilizing light being wirelessly controlled by the selector and the draw sensor.

11. An archery apparatus comprising:

a bow string; and a body operatively coupled to the bow string, the body including a draw sensor and a control device, wherein the control device is configured to control electrical accessory devices in proximity to the body, the controlling including controlling a supply of power, and wherein the control device is configured to be activated by the draw sensor, the activation of the control device providing power to certain electrical accessory devices in proximity to the body, and wherein the draw sensor is configured to activate the control device when said bow string is drawn back, wherein the control device is a wireless control device, wherein the control device is configured to control electrical accessory devices in proximity to the body including wirelessly controlling electrical accessory devices in proximity to the body, the wireless controlling including controlling a supply of power;

wherein the supply of power includes one or more power supplies for each of the electrical accessory devices, the one or more supplies being respectively provided by the electrical accessory devices, and wherein the wireless control is provided by one of RF signals or IR signals.

12. The archery apparatus of claim 11, wherein the electrical accessory devices include at least one of a light, a sight light, a stabilizing light, a spot light, a video device, a photographic device, an audio enhancement device, a reel device, a game calling device, a range finder device, a sighting device, and a lighted quiver device.

13. A system for controlling activation of one or more accessory devices in proximity to an archery apparatus including a bow string, the system comprising:

means for detecting movement of the bow string indicating that the bow string has been drawn back;

means for wirelessly controlling power supplied to said one or more of said accessory devices for activation thereof in response to said detecting; and means for coupling to a first external body portion of the archery apparatus said means for wirelessly controlling power.

14. The system for controlling activation of one or more accessory devices in proximity to an archery apparatus including a bow string according to claim 13, further comprising:

means for wirelessly selecting said one or more accessory devices for activation thereof in response to said detecting; and means for coupling to a second external body portion of the archery apparatus said means for wirelessly selecting said one or more accessory devices for activation, wherein said means for wirelessly controlling power includes wireless connection means for wirelessly communicating with said means for wirelessly selecting said one or more accessory devices for activation in response to said detecting, said wireless connection means being exposed from the body of the archery apparatus.

15. The system for controlling activation of one or more accessory devices in proximity to an archery apparatus including a bow string according to claim 14, wherein said means for wirelessly selecting said one or more accessory devices for activation uses a plurality of wireless communication channels, each said one or more accessory device having associated therewith one of said plurality of wireless communication channels.

16. The system for controlling activation of one or more accessory devices in proximity to an archery apparatus including a bow string according to claim 14, wherein said means for wirelessly selecting said one or more accessory devices for activation thereof in response to said detecting is configured to selectively allow none, only one, only some, or all electrical accessory devices to be operated substantially simultaneously,

17. The system for controlling activation of one or more accessory devices in proximity to an archery apparatus including a bow string according to claim 14, wherein said means for wirelessly selecting said one or more accessory devices for activation thereof in response to said detecting is configured to selectively allow none, only one, only some, or all electrical accessory devices to remain activated until manually deactivated.

18. The system for controlling activation of one or more accessory devices in proximity to an archery apparatus including a bow string according to claim 14, wherein said means for wirelessly selecting said one or more accessory devices for activation thereof in response to said detecting is configured to selectively allow none, only one, only some, or all electrical accessory devices to remain activated for a predetermined time period.

19. The system for controlling activation of one or more accessory devices in proximity to an archery apparatus including a bow string according to claim 14, wherein said means for wirelessly selecting said one or more accessory devices for activation thereof in response to said detecting is configured to selectively allow none, only one, only some, or all electrical accessory devices to be immediately deactivated after being activated.

20. The system for controlling activation of one or more accessory devices in proximity to an archery apparatus including a bow string according to claim 13, wherein said means for wirelessly controlling power includes means for selecting said one or more accessory devices for activation thereof in response to said detecting.

21. A method for automatically activating a plurality of devices associated with a compound bow in response to a user drawing a bow string of the compound bow, the method comprising:

receiving a signal from a draw sensor indicating said bow string is in a drawn state, said drawn state indicating said bow string is being or has been drawn;

activating, if said bow string is in a drawn state, one or more of said plurality of devices; and deactivating, after a predetermined period of time, one or more of said plurality of devices that were activated.

22. The method of claim 21, wherein one or more of said one or more of said plurality of devices that were activated remain activated until manually deactivated by the user.

* * * * *